US011859879B1

(12) United States Patent
Mokheimer et al.

(10) Patent No.: US 11,859,879 B1
(45) Date of Patent: Jan. 2, 2024

(54) SOLAR AUGMENTED CHILLED-WATER COOLING SYSTEM

(71) Applicants: KING FAHD UNIVERSITY OF PETROLEUM AND MINERALS, Dhahran (SA); King Abdullah City for Atomic & Renewable Energy (K.A.CARE), Riyadh (SA)

(72) Inventors: Esmail M. A. Mokheimer, Dhahran (SA); Mohammad R. Shakeel, Dhahran (SA)

(73) Assignees: KING FAHD UNIVERSITY OF PETROLEUM AND MINERALS, Dhahran (SA); King Abdullah City for Atomic & Renewable Energy (K.A.CARE), Riyadh (SA)

( * ) Notice: Subject to any disclaimer, the term of this patent is extended or adjusted under 35 U.S.C. 154(b) by 0 days.

(21) Appl. No.: 17/870,438

(22) Filed: Jul. 21, 2022

(51) Int. Cl.
*F25B 25/02* (2006.01)
*F24F 5/00* (2006.01)
*F25B 27/00* (2006.01)

(52) U.S. Cl.
CPC ..... *F25B 25/02* (2013.01); *F24F 5/0046* (2013.01); *F25B 27/005* (2013.01); *F25B 27/007* (2013.01); *F24F 2005/0067* (2013.01)

(58) Field of Classification Search
CPC ..... F25B 25/02; F25B 27/005; F25B 27/007; F24F 5/0046; F24F 2005/0067
USPC ..... 62/79
See application file for complete search history.

(56) References Cited

U.S. PATENT DOCUMENTS

| | | | | |
|---|---|---|---|---|
| 4,273,184 | A | 6/1981 | Tanaka et al. | |
| 6,539,738 | B2 | 4/2003 | González-Cruz et al. | |
| 2018/0283744 | A1* | 10/2018 | Pahwa | F24F 5/0014 |
| 2021/0285700 | A1 | 9/2021 | Brillhart | |

FOREIGN PATENT DOCUMENTS

| | | | |
|---|---|---|---|
| CN | 110207249 | A | 9/2019 |

OTHER PUBLICATIONS

Jing, et al. ; Exergoeconomic Assessment of Solar Absorption and Absorption-Compression Hybrid Refridgeration in Building Cooling ; Entropy 20, 130 ; Feb. 17, 2018 ; 23 Pages.

(Continued)

*Primary Examiner* — Steve S Tanenbaum
(74) *Attorney, Agent, or Firm* — Oblon, McClelland, Maier & Neustadt, L.L.P.

(57) ABSTRACT

The solar augmented chilled-water cooling system comprises a refrigeration cycle, a cooling tower, an air handling unit (AHU), a supplemental cycle and a solar energy harvesting unit. The supplemental cycle is in fluid communication with the refrigeration cycle, which is in fluid communication with the cooling tower, which in turn is in fluid communication with the supplemental cycle. The cooling tower cools a water stream by evaporation. The water stream from the cooling tower is passed to the supplemental cycle for further cooling using energy from the solar energy harvesting unit. The water stream is then passed to a condenser of the refrigeration cycle for its efficient operation at proper temperature. The water stream is then retuned back to the cooling tower to be re-cooled. In the refrigeration cycle, an evaporator uses operation of the associated condenser for providing cooling effect through the AHU.

15 Claims, 14 Drawing Sheets

(Cont'd)

(56) References Cited

OTHER PUBLICATIONS

Bawazir, et al. ; Evaluation and Design of Large-Scale Solar Adsorption Cooling Systems on Energetic, Economic and Environmental Performance ; Energies 15, 2149 ; Mar. 15, 2022 ; 24 Pages.

* cited by examiner

SOLAR AUGMENTED CHILLED-WATER COOLING SYSTEM

BACKGROUND

Technical Field

The present disclosure is directed to cooling systems for large building HVAC (Heating, ventilation, and air conditioning) units, and more particularly to a cooling system utilizing a refrigerant cycle supported by a cooling tower associated with a solar-assisted supplemental cycle for its efficient operations.

Description of Related Art

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

There are several known refrigerant cycles that are used for cooling purposes, such as vapor compression systems, ejector enhanced vapor compression systems, and vapor absorption systems. Depending upon the type of application such as small room cooling or large building cooling, the design of these cooling systems varies. For instance, for small rooms in houses or the like, a single air conditioning unit utilizing any of the mentioned refrigerant cycles (usually, vapor compression system) may be used for cooling purposes. For large scale cooling of buildings, water-chilled air conditioning units are used which additionally utilizes one or more cooling towers to supplement the employed air-conditioning unit [See: Chen G, Ierin V, Volovyk Shestopalov K.—An improved cascade mechanical compression—ejector cooling cycle, Energy 2019, 170:459-70].

Thus, the water-chilled air conditioning unit utilizes cooling towers to disperse the heat from the cooling space to the environment. Typically, water enters the cooling tower at a temperature of 28-44 Celsius and exits at around 20-28 Celsius. There are several types and designs of cooling towers that have been proposed and are used widely [See: Kim J K, Smith R.—Cooling water system design, Chem Eng Sci 2001, 56:3641-58; and Milosavljevic N, Heikkila P.—A comprehensive approach to cooling tower design, Applied Thermal Engineering 2001, 21:899-915]. One of the earliest designs was proposed by Seymour [See: Seymour JM. J. m. seymour, jr. 1899:0-3]. It was designed for moderately cooling the large quantities of condensing water required to maintain vacuum in the use of low-pressure engines where only a limited supply of water was available. Several other designs have been proposed to improve the cooling tower designs [See: John Engalitcheff J.—Water Injected Cooling Tower, 253781, 1979; John Engalitcheff J.—Water Injected Cooling Tower, 253783, 1979; Weng K-L—Cooling Water Tower, 5970724, 1999; Ireland R G, Tramontini V N—Dry Cooling Tower With Water Augmentation, 4274481, 1981; Derham J J, Hannigan J M, Derham J.—Cooling Tower System, 4931187, 1990; Meyer-Pittroff R.—Evaporation Cooling Tower, 1987; Slough J M.—Water Cooling Tower, 3078080, 1963; Takeda Z.—Cooling Tower, U.S. Pat. No. 3,286,999, 1966; Paugh F E.—Water Tower, U.S. Pat. No. 3,165,902, 1965; Copeland J H.—Water Cooling Tower, U.S. Pat. No. 3,669,425, 1972; Slaughter G M, Puls G.—Cooling Tower, U.S. Pat. No. 2,571,958, 1951; Doyle F M.—Cooling Tower, U.S. Pat. No. 1,647,281, 1927; Alston G.—Thermally Enhanced Cascade Cooling System, US Patent Application No. 2011/0289953 A1, 2011; Stephens F M.—Mechanical Draft Water Cooling Tower, U.S. Pat. No. 2,636,371, 1953; Seymour J M.—Water Cooling Tower, U.S. Pat. No. 62,718, 1899; Hauswirth F.—Water Cooling Tower, U.S. Pat. No. 808,050, 1905; Bernard F. Duesel J, Rutsch M J—Cooling Tower, U.S. Pat. No. 8,136,797 B2, 2012; Koo J-B—Hybrid Type Cooling Tower, U.S. Pat. No. 6,938,885 B2, 2005; Kuehl S J.—Thermal Cascade System For Distributed Household Refrigeration System, U.S. Pat. No. 8,245,524 B2, 2012; Datta C.—Cascade Refrigeration System, U.S. Pat. No. 5,170,639, 1992; Qian T, Qian X—Water Tower Applied To The Water Source Heat Pump Central Air Conditioner, U.S. Pat. No. 9,964,318 B2, 2018; Kato K—Process For Cooling Water And Cooling Tower, U.S. Pat. No. 5,468,426, 1996; and Gopal P. Maheshwari, Al-Bassam E—Cooling Tower And Method For Optimizing Use Of Water And Electricity, U.S. Pat. No. 6,446,941, 2002].

Some designs have been proposed in the literature that can help address the challenge of cooling in high humid conditions. For instance, U.S. Pat. No. 6,257,007 B1 proposes a method to vary the speed of condenser fans, cooling tower fans, and the pump speed to adjust the cooling performance of the water-chilled cooling system. This method improves the cooling performance during hot and humid conditions, but requires additional electrical energy from the power grid during a peak time when the grid load is already significantly high, which is not desirable or even feasible in many scenarios.

U.S. Pat. No. 9,506,697 B2 proposes the use of a liquid desiccant system to absorb the humidity from the air entering the cooling tower, thus maintaining the cooling performance of the tower. It may be understood that such liquid desiccant systems use corrosive liquids that can pose risk of damage to the cooling towers, moreover, some of the liquid used in the desiccant systems may be prone to crystallization, limiting the longevity of such systems and resulting in increased operational cost.

US Patent Application No. 2011/0113798 A1 proposes a cooling tower design wherein the incoming air is first cooled using a precooler. The precooler utilizes the water from the sump of the cooling tower. The air after passing through the precooler is passed through an evaporative heat exchanger wherein the air absorbs heat from the water being sprayed from the top of the tower. Such design is basically a multistage cooling system, which may be difficult to be incorporated with existing chilling units.

U.S. Pat. No. 8,899,061 B2 proposes a multistage evaporative cooling system which has been claimed to cool the water exiting the cooling tower to below the wet-bulb temperature of the ambient air. The system utilizes two or more cooling tower that work in series. Large amounts of air enters the first cooling tower, where some of the air absorbs heat from the water being sprayed and exits the first cooling tower. The cold water from the sump of the first cooling tower is then passed to an air-water heat exchanger that is placed at the air inlet of the second cooling tower. Remaining air from the first tower now travels through the heat exchanger to the second tower. While passing through the air water heat exchanger the air rejects heat to the water resulting in air with temperatures lower than the ambient. This air can then be used to cool the water coming from the condenser of the vapor compression cycle. This method is complicated, requires large spaces and cannot be easily incorporated with existing chilled water system to improve performance during hot and humid conditions.

U.S. Pat. No. 4,273,184 proposes a solar heat utilized air-conditioning system comprising: a solar heat collecting unit for producing warm water by heating a circulating heating medium water by solar heat obtained by collector plates disposed in parallel with each other; an absorption type refrigerating machine for producing cold water by commencing a refrigerating cycle, using the warm water produced by said solar heat collecting unit as the heat source for a generator; a main heat exchanger which indirectly heat-exchanges an intake fresh-air for a circulating cold or warm water in an air-conditioning unit disposed on near a fresh-air intake path to a space to be air-conditioned, thereby producing cooled or heated air; an air-cooling and heating apparatus capable of selectively supplying the circulating cold or warm water to said main heat exchanger; and an auxiliary heat exchanger capable of selectively flowing either warm water produced by said solar heat collecting unit or cold water produced by said absorption type refrigerating machine, said main heat exchanger and said auxiliary heat exchanger being disposed in parallel with and adjacent to each other in said air-conditioning unit with said auxiliary heat exchanger disposed at the fresh-air intake side thereof. The proposed solar heat utilized air-conditioning system may not be compatible to incorporated with existing chilling units, and may require significant modifications to achieve the same.

U.S. Pat. No. 6,539,738 B2 discloses a compact solar-powered air conditioning system operates without a cooling tower. The air conditioning system includes solar collectors, a storage tank, and an absorption machine. The solar collectors are positioned to collect energy and to heat water as it passes along a path through their interior. The heated water is passed to the storage tank. The heated water in the storage tank is used to drive the absorption machine, which includes a desorber, a condenser, an evaporator and an air-cooled absorber. The desorber receives the heated water and causes a refrigerant to change from a liquid state to a gaseous state. The condenser then receives the refrigerant in the gaseous state and causes the refrigerant to return to a liquid state. The evaporator then receives the refrigerant in the liquid state and returns the refrigerant to a gaseous state. This change from the liquid state to the gaseous state is able to absorb energy from an external cooling loop. Finally, the absorber then receives the refrigerant in the gaseous state and circulates an absorbent solution in the presence of the refrigerant. The absorber releases heat of dilution and heat of condensation. This heat is exhausted by passing ambient air over the absorber. This reference does not provide any details for reducing the temperature of the inlet water to the condenser of the refrigerant cycle, and also does not propose incorporating the cooling tower for such purposes.

Each of the aforementioned references suffers from one or more drawbacks hindering their adoption. None of the references provide a solution that can address the issue at the peak load during summer hot and humid days by use of vapor absorption or vapor compression based refrigeration cycle, and specifically utilizing solar energy to reduce an inlet temperature of the condenser water resulting in improved efficiency even during hot and humid conditions, and which may further be simple enough to be incorporated with existing chilling units requiring little modifications.

Accordingly, it is one object of the present disclosure to provide a solar augmented chilled-water cooling system which is able to reduce the inlet temperature of the condenser of the refrigeration cycle to address the issue at the peak load on electricity grid during summer hot and humid days.

SUMMARY

In an exemplary embodiment, a solar augmented chilled-water cooling system is provided. The system comprises a main chiller, an air handling unit (AHU) and a cooling tower, that is augmented by a solar-driven vapor absorption system or a solar powered vapor compression system. The vapor absorption system comprises a first evaporator, a first condenser, a generator, and an absorber. The vapor absorption system further comprises a parabolic trough collector (PTC) system comprising a plurality of parabolic troughs. The vapor absorption system further comprises a first pump and a second pump, and a first throttling valve. A hot outlet stream from the second condenser is connected to an inlet of the cooling tower, and a cool water stream from the cooling tower is connected to a first three-way valve. The vapor absorption system is in fluid communication with the vapor compression system via a fourth pump. The vapor compression system comprises a compressor, a second condenser, a third pump, a second evaporator, a second throttling valve. The vapor compression system is in fluid communication with the cooling tower. The cooling tower comprises a plurality of chillers, a plurality of tubes to transfer a coolant fluid to the plurality of chillers, a first heat exchanger. The cooling tower is in fluid communication with the vapor absorption system through a first three-way valve. The cooling tower has a plurality of slits configured so that cool air enters the cooling tower through the slits and exits through the top of the tower. The cooling tower is configured to supply water to the first evaporator to further reduce the temperature of water from the cooling tower via the first three-way valve. The cool water stream from the cooling water tower is in fluid communication with an inlet stream of the first evaporator. An outlet stream of the first evaporator is in fluid communication with a second three-way valve, wherein an outlet stream from the second three-way valve is connected to the fourth pump. A temperature difference between the inlet stream of the first evaporator and an outlet stream of the first evaporator is between 20° C. and 60° C. A water stream exiting the generator is pumped via the fourth pump to the second condenser. The cooling tower is configured to directly supply water to the second condenser via the first three-way valve. The cooling tower allows a fraction of the water to pass through the first evaporator before mixing with remaining water coming directly from the cooling tower and passing to the second condenser. The PTC system provides thermal energy to the generator where a liquid with low boiling point is evaporated to form a vapor.

In one or more exemplary embodiments, the vapor absorption system is replaced with a second vapor compression system, and further comprises a plurality of PV panels which are electrically connected to a battery that is connected to the compressor of the second vapor compression cycle. In one or more exemplary embodiments, the water from the cooling tower passes through the second evaporator before traveling to the second condenser. In one or more exemplary embodiments, the plurality of PV panels is connected in parallel. In one or more exemplary embodiments, the plurality of PV panels is connected in series.

In one or more exemplary embodiments, the power conditioning unit further comprises an AC connect and a DC connect to supply power to the vapor compression system.

In one or more exemplary embodiments, the second evaporator comprises a second heat exchanger. In one or more exemplary embodiments, the second heat exchanger is in fluid communication with the air handling unit.

In one or more exemplary embodiments, the cooling tower is fluidly connected to the vapor absorption system by a first three-way valve to pass the water stream through the first three-way valve.

In one or more exemplary embodiments, the PTC is fluidly connected to the generator.

In one or more exemplary embodiments, the cooling tower is fluidly connected to second condenser by passing a water stream exiting the second condenser to the cooling tower.

In one or more exemplary embodiments, the first evaporator is fluidly connected to the second condenser by passing a water stream exiting the first evaporator to the second condenser. In one or more exemplary embodiments, the first evaporator is fluidly connected to the second condenser by a second three-way valve. In one or more exemplary embodiments, the first evaporator is fluidly connected to the second condenser by passing the water stream exiting the second three-way valve through the fourth pump to the second condenser.

In one or more exemplary embodiments, the second evaporator is fluidly connected to the AHU by passing a water stream exiting the second evaporator to the AHU through the third pump. In one or more exemplary embodiments, the AHU is fluidically connected to the second evaporator by exposing the water stream to a supplied air stream in the AHU and returning the water stream to the second evaporator.

In one or more exemplary embodiments, the second heat exchanger is fluidically connected to the AHU to exchange heat with an air stream returning from the AHU.

In one or more exemplary embodiments, the system includes a second vapor compression system which comprises six three-way valves to exchange heat with the AHU.

The foregoing general description of the illustrative embodiments and the following detailed description thereof are merely exemplary aspects of the teachings of this disclosure, and are not restrictive.

BRIEF DESCRIPTION OF THE DRAWINGS

A more complete appreciation of this disclosure and many of the attendant advantages thereof will be readily obtained as the same becomes better understood by reference to the following detailed description when considered in connection with the accompanying drawings, wherein.

DETAILED DESCRIPTION

Figure 1:
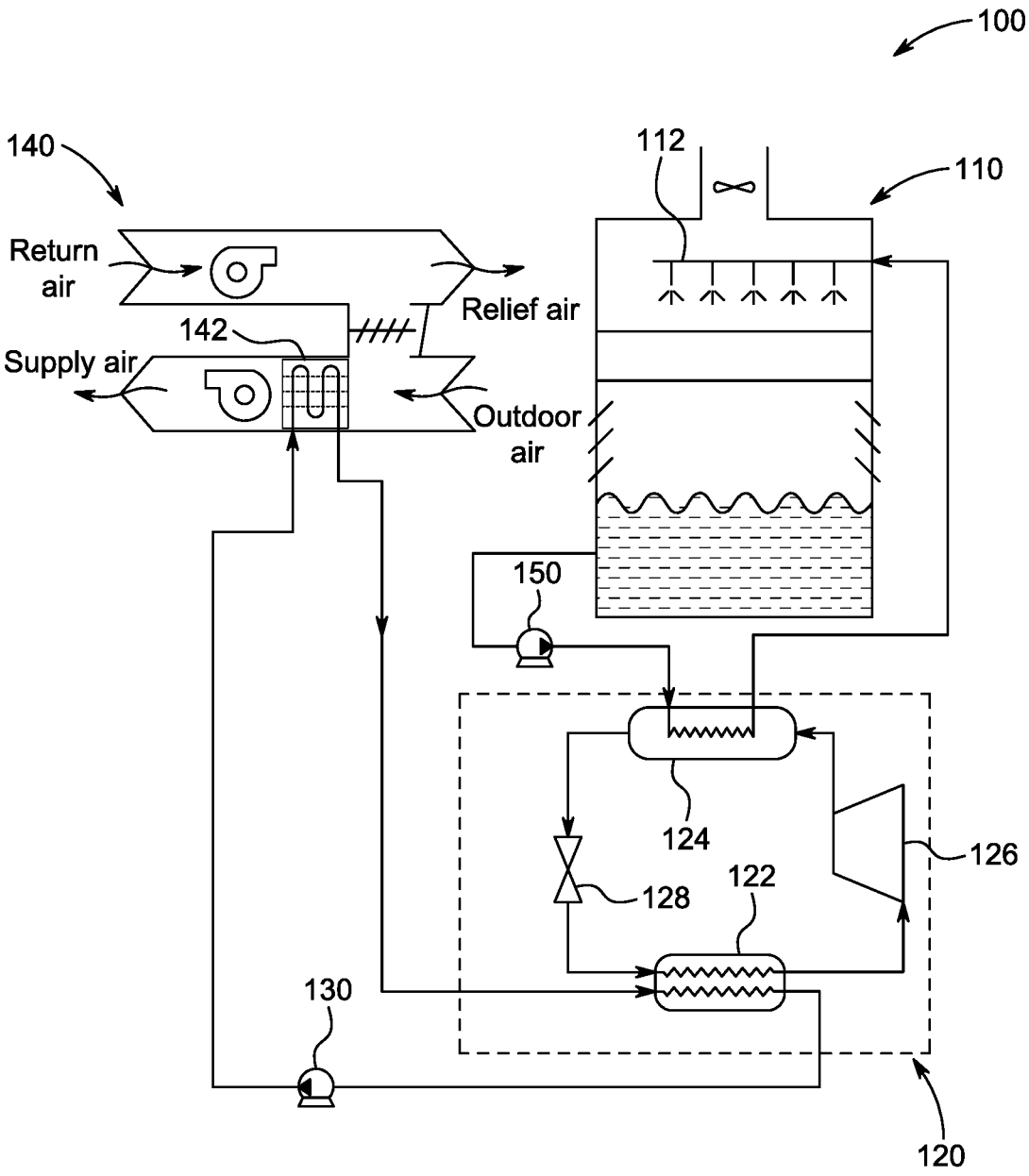
FIG. 1 PRIOR ART
FIG. 1 is a schematic diagram of a water-chilled cooling system.

In the drawings, like reference numerals designate identical or corresponding parts throughout the several views. Further, as used herein, the words "a," "an" and the like generally carry a meaning of "one or more," unless stated otherwise.

Furthermore, the terms "approximately," "approximate," "about," and similar terms generally refer to ranges that include the identified value within a margin of 20%, 10%, or preferably 5%, and any values therebetween.

Aspects of this disclosure are directed to a solar augmented chilled-water cooling system that aims to provide a solution to address peak load during summer hot and humid days. The solar augmented chilled-water cooling system utilizes solar energy to reduce the inlet temperature of condenser water resulting in improved efficiency even during hot and humid conditions. In particular, the present system incorporates a solar energy harvesting unit to capture energy to be utilized by a vapor absorption cycle or a vapor compression cycle to further cool chilled water as received from a cooling tower before being passed to the condenser. This results in improved efficiency of the condenser and thus reduces peak electricity demand even during hot and humid conditions. The present system is designed to be simple enough to be incorporated with existing chilling units.

While the implementation of chillers (such as, a cooling tower) improve the cooling efficiency of chiller plants, they may still be prone to underperformance in high-temperature, humid environments, such as that of Saudi Arabia. For instance, it may be noted that during the summer months, some parts of Saudi Arabia experience high temperatures upwards of 45° C. in addition to high humidity, especially in the coastal cities of Dammam, Dhahran and Jeddah which are large population hubs. Such high temperature increases the cooling load (cooling demand) of building units and affects the performance of the chillers. Furthermore, during such times of high cooling load, the chiller also experiences a decrease in its cooling capacity due to the high humid conditions prevailing around the cooling tower reducing the cooling performance of the cooling tower, resulting in high-temperature water going into the condenser of the vapor compression cycle/refrigerant loop.

FIG. 1 illustrates a schematic diagram of a water-chilled cooling system 100, sharing certain features of the present disclosure. The water-chilled cooling system 100 includes a cooling tower 110 integrated to interact with a water cooled chiller 120. In some embodiments, the cooling tower 110 has a height of from 10 meters (m) to 150 m, preferably 20 m to 140 m, preferably 30 m to 130 m, preferably 40 m to 120 m, preferably 50 m to 110 m, preferably 60 m to 100 m, preferably 70 m to 90 m, or 90 m. In some embodiments, the cooling tower 110 has a diameter of from 10 m to 100 m, preferably 20 m to 90 m, preferably 30 m to 80 m, preferably 40 m to 70 m, preferably 50 m to 60 m, or 55 m. In some embodiments, the water level in the cooling tower 110 is maintained by a water level sensor (not shown). In some embodiments, the cooling tower 110 includes a variable speed-fan for forcing air to the chiller 120. In some embodiments, the system 100 includes multiple cooling towers 110 in series, preferably 2 to 10 towers, preferably 3 to 9 towers, preferably 4 to 8 towers, preferably 5 to 7 towers, or 6 towers. In the present example, the water cooled chiller 120 is based on the vapor compression refrigeration cycle. The function of the water cooled chiller 120 is to generate "chilled water" for air conditioning by removing the unwanted heat from a building. In some embodiments, the refrigerant used by the chiller 120 is water. In some embodiments, the water refrigerant contains a percentage of glycol, propylene, or corrosion inhibitors. The water cooled chiller 120 includes an evaporator 122, a condenser 124, a compressor 126 and a throttling valve 128. The evaporator 122 generates the chilled water, which is pumped out by a pump 130 therefrom. In some embodiments, the evaporator 122 contains chilled water tubes made out of steel, PVC, metal, plastic, iron, or alloys. In some embodiments, the tubes of the evaporator have a diameter of from 10 mm to 100 mm, preferably 20 mm to 90 mm, preferably 30 mm to 80 mm preferably 40 mm to 70 mm preferably 50 mm to 60 mm, or 55 mm. In some embodiments, the condenser 124 can accommodate a flow rate of from 1 gallon/minute to 20 gal/min, preferably 2 gal/min to 18 gal/min, preferably 4 gal/min to 16 gal/min, preferably 6 gal/min to 14 gal/min, preferably 8 gal/min to 12 gal/min, or 10 gal/min. In some embodiments, the condenser 124 can accommodate temperatures ranging from 10° C. to 50° C., preferably 12.5° C. to 47.5° C., preferably 15° C. to 45° C., preferably 17.5° C. to 42.5° C., preferably 20° C. to 40° C., preferably 22.5° C. to 37.5° C., preferably 25° C. to 35° C., preferably 27.5° C. to 32.5° C., or 30° C. In some embodiments, the compressor 126 requires a power ranging from 1000 Watts (W) to 10,000 W, preferably 2,000 W to 9,000 W, preferably 3,000 W to 8,000 W, preferably 4,000 W to 7,000 W, preferably 5,000 W to 6,000 W, or 5,500 W. In some embodiments, the compressor 126 operates with a condensing temperature range from 20° C. to 40° C., preferably 22.5° C. to 37.5° C., preferably 25° C. to 35° C., preferably 27.5° C. to 32.5° C., or 30° C. In some embodiments, the throttling valve 128 can accommodate pressures ranging from between 50 pounds per square inch (psi) to 500 psi, preferably 100 psi to 450 psi, preferably 150 psi to 400 psi, preferably 200 psi to 350 psi, preferably 250 psi to 300 psi, or 275 psi. In some embodiments, the pump 130 can accommodate a flow rate of from 5 gallon/minute to 40 gal/min, preferably 10 gal/min to 35 gal/min, preferably 15 gal/min to 30 gal/min, preferably 20 gal/min to 25 gal/min, or 22.5 gal/min. In some embodiments, the pump 130 requires a power of 3000 Watts (W) to 15,000 W, preferably 4,000 W to 14,000 W, preferably 5,000 W to 13,000 W, preferably 6,000 W to 12,000 W, preferably 7,000 W to 11,000 W, preferably 8,000 W to 10,000 W, or 9,000 W. The pumped chilled water is passed to an Air Handling Unit (AHU) 140 which sucks "indoor air" from the building and the outdoor "fresh air". In some embodiments, the AHU 140 includes air particulate filters to filter out contaminants in the indoor and outdoor air. In some embodiments, the AHU 140 has a plurality of fans ranging from 4 to 16 fans, preferably 5 to 15 fans, preferably 6 to 14 fans, preferably 7 to 13 fans, preferably 8 to 12 fans, preferably 9 to 11 fans, or 10 fans. The AHU 140 includes a heat exchanger 142 which has the received chilled water flowing through, and which absorbs the heat of the indoor and outdoor air blowing across in the AHU 140 and cools it down to be supplied back to the building as "supply air", while the chilled water heats up therein. In some embodiments, the heat exchanger 142 is a fin and tube heat exchanger, double tube heat exchanger, a shell and tube heat exchanger, a tube in tube heat exchanger, or a plate heat exchanger. The warm chilled water then heads back to the evaporator 122, where a refrigerant absorbs the unwanted heat to be passed to the condenser 124, via the compressor 126. Another loop of water, known as "condenser water", passes in a loop between the condenser 124 and the cooling tower 110. The refrigerant collects the heat from the "chilled water" loop in the evaporator 122 and moves this to the "condenser water" loop in the condenser 124. Further, the condenser water is pumped up to the cooling tower 110 and it is sprayed via a plurality of nozzles 112 therein. In some embodiments, the nozzles 112 can operate under pressures ranging from 10 psi to 250 psi, preferably 25 psi to 225 psi, preferably 50 psi to 200 psi, preferably 75 psi to 175 psi, preferably 100 psi to 150 psi, or 125 psi. In some embodiments, the nozzles take on the conical shape, or ring shape, or flat-tipped shape, or convergent shape. The ambient air enters the cooling tower 110 and come in contact with the sprayed condenser water to allow the heat of the condenser water to transfer into the air, and this air is then blown out into the atmosphere. This cooled condenser water is collected in the cooling tower 110 and is pumped back via a second pump 150 to the condenser 124 of the water cooled chiller 120 to collect more heat. In some embodiments, the second pump 150 can accommodate a flow rate of from 5 gallon/minute to 40 gal/min, preferably 10 gal/min to 35 gal/min, preferably 15 gal/min to 30 gal/min, preferably 20 gal/min to 25 gal/min, or 22.5 gal/min. In some embodiments, the second pump 150 requires a power of 3000 Watts (W) to 15,000 W, preferably 4,000 W to 14,000 W, preferably 5,000 W to 13,000 W, preferably 6,000 W to 12,000 W, preferably 7,000 W to 11,000 W, preferably 8,000 W to 10,000 W, or 9,000 W.

Figure 2:
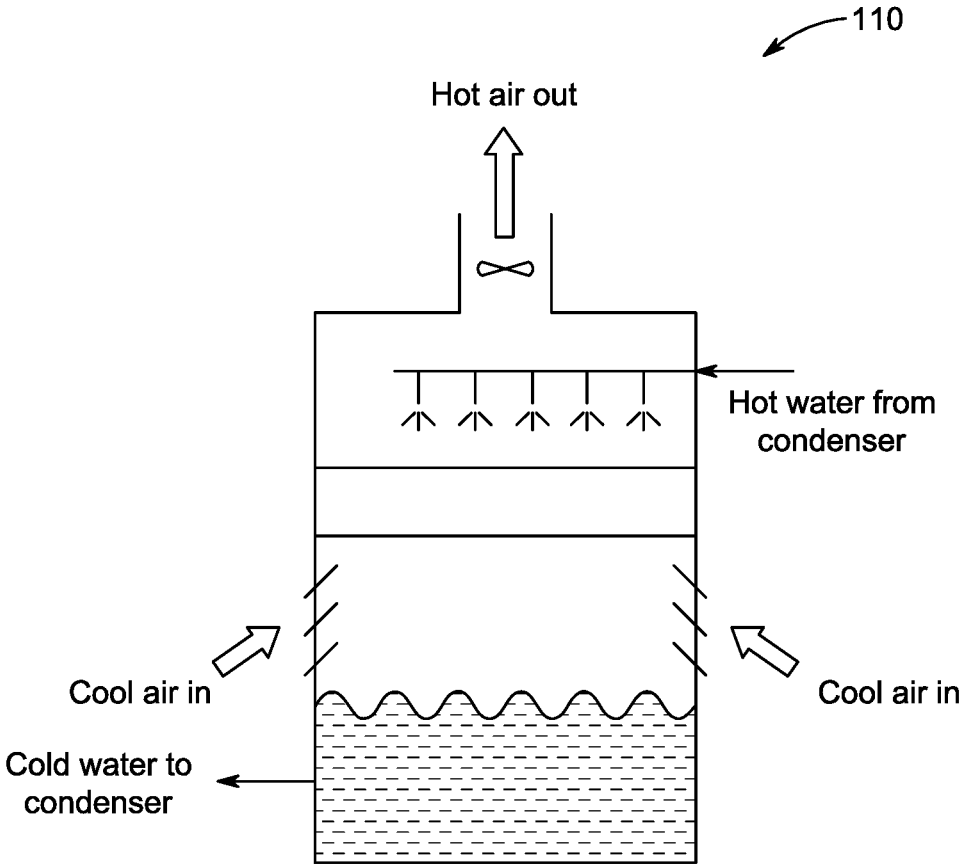
FIG. 2 PRIOR ART
FIG. 2 is a schematic diagram of a cooling tower depicting operation thereof.

FIG. 2 illustrates a schematic diagram of the cooling tower 110 depicting operation thereof, sharing features of the present disclosure. The cooling tower 110 cools the water coming from the condenser of the vapor compression cycle (as described in the preceding paragraphs). The cooling tower 110 is a kind of heat and mass exchanger where air and hot water are brought into direct contact with each other to induce evaporative cooling. The heat of evaporation at the surface of water droplets is extracted from the main body of the water droplet and the surrounding air. This results in cooling the condenser water, the temperature of which, significantly drops to the dew point temperature of the ambient air in the vicinity of the cooling tower 110. In some embodiments, the cooling tower 110 has a fill material inside the cooling tower configured to increase to surface area for air-water heat exchange. During the evaporative cooling process, the air has to be unsaturated so that it can store the evaporated water vapors. The cooling tower 110 may only reduce the water temperature to the wet-bulb temperature of the surrounding air. In some embodiments, the cool air enters the cooling tower 110 through a first set of slits and second set of slits. It may be understood that if the humidity in the air is high, the wet-bulb temperature is higher, resulting in a decrease in the cooling capacity of the cooling tower 110. In some embodiments, the slits are substantially to allow air flow upward towards the nozzles. In some embodiments, both the first and second set of slits ranges from 3 to 20 slits, preferably 4 to 18 slits, preferably 6 to 16 slits, preferably 8 to 14 slits, preferably 10 to 12 slits, or 11 slits. In some embodiments, the first and second set of slits are angled in a range from 15° to 165° with respect to the interior wall of the cooling tower, preferably 30° to 150°, preferably ° to 135°, preferably 60° to 120°, preferably 75° to 105°, or 90°.

Figure 3:
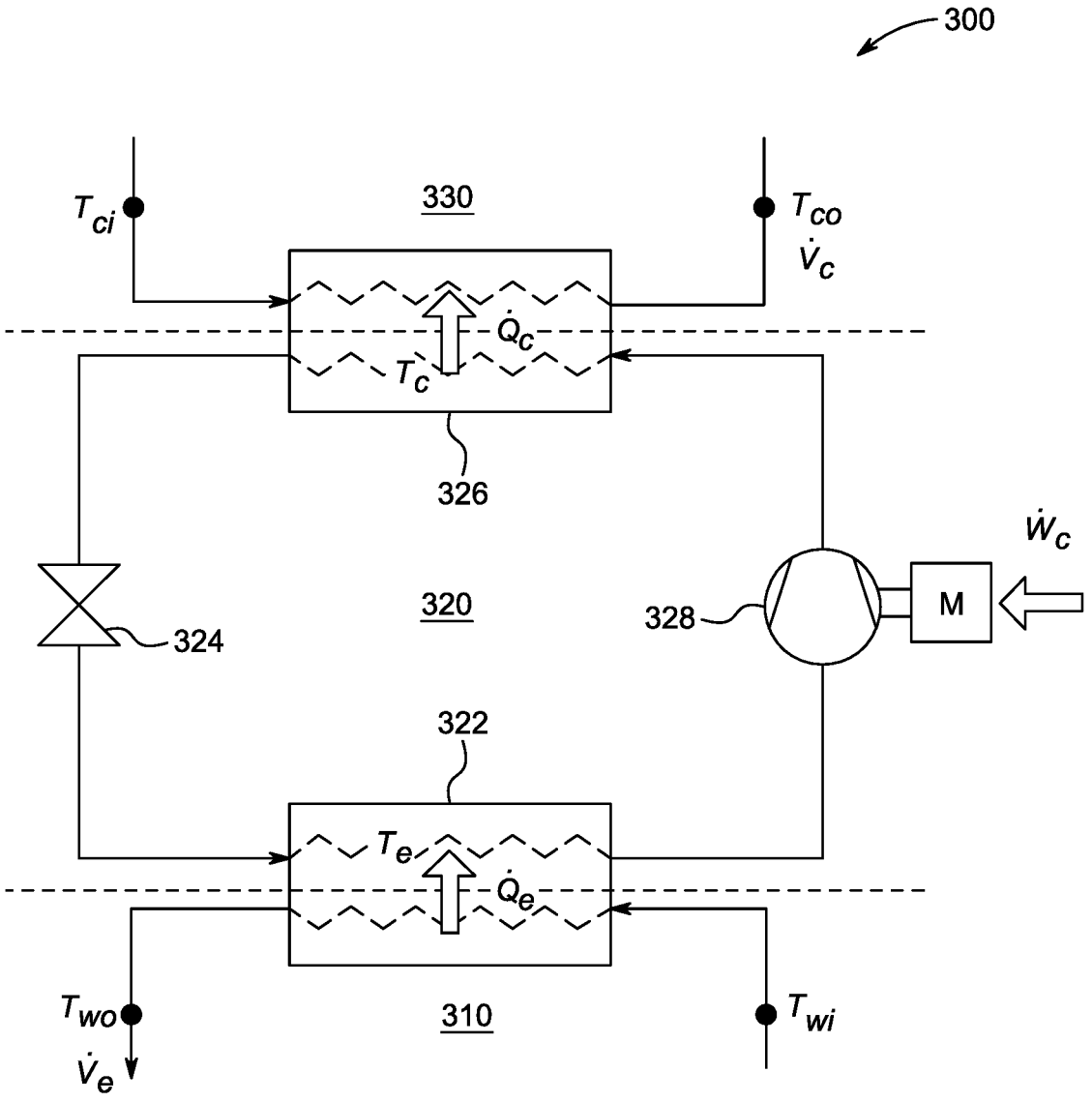
FIG. 3 is a simplified schematic diagram of a vapor compression based water chiller, according to certain embodiments.

As discussed, one objective of the present disclosure is to reduce the inlet temperature of condenser water (sometimes, referred to as "condenser water inlet temperature" of the refrigerant cycle. FIG. 3 illustrates a simplified schematic diagram of a typical vapor compression based water chiller (as represented by reference numeral 300) to highlight and to perform an analysis of the impact of reduced temperature of condenser water on the refrigerant cycle. The water chiller 300 includes three closed loops that exchange heat with each other, namely a chilled water loop (as represented by reference numeral 310), a refrigerant loop (as represented by reference numeral 320), and a condenser water loop (as represented by reference numeral 330). The chilled water loop 310 cools the air handling units of the buildings, wherein $T_{wo}$ represents the outlet temperature of water to the evaporator of the chiller, $V_e$ represents the volumetric flow rate of the water through the loop 310, $T_e$ represents the operating temperature of the evaporator, $\dot{Q}_c$ represents the thermal load on the condenser, $T_c$ represents the operating temperature of the condenser, $T_{co}$ represents the outlet temperature of water to the condenser of the chiller, T, represents the operating temperature of the condenser, $V_c$ represents the volumetric flow rate of the water through the loop 330 through the condenser, $W_c$ represents the power of the compressor, and M is a sensor for the compressor. The refrigerant loop 320 which is typically a vapor compression cycle, having an evaporator 322, a throttling valve 324, a condenser 326 and a compressor 328, cools the chilled water. In some embodiments, the evaporator 322 contains chilled water tubes made out of steel, PVC, metal, plastic, iron, or alloys. In some embodiments, the tubes of the evaporator 322 have a diameter of from 10 mm to 100 mm, preferably 20 mm to mm, preferably 30 mm to 80 mm preferably 40 mm to 70 mm preferably 50 mm to 60 mm, or mm. In some embodiments, the throttling valve 324 can accommodate pressures ranging from between 50 pounds per square inch (psi) to 500 psi, preferably 100 psi to 450 psi, preferably 150 psi to 400 psi, preferably 200 psi to 350 psi, preferably 250 psi to 300 psi, or 275 psi. In some embodiments, the condenser 326 can accommodate a flow rate of from 1 gallon/minute to 20 gal/min, preferably 2 gal/min to 18 gal/min, preferably 4 gal/min to 16 gal/min, preferably 6 gal/min to 14 gal/min, preferably 8 gal/min to 12 gal/min, or 10 gal/min. In some embodiments, the condenser 326 can accommodate temperatures ranging from 10° C. to 50° C., preferably 12.5° C. to 47.5° C., preferably 15° C. to 45° C., preferably 17.5° C. to 42.5° C., preferably 20° C. to 40° C., preferably 22.5° C. to 37.5° C., preferably 25° C. to 35° C., preferably 27.5° C. to 32.5° C., or ° C. In some embodiments, the compressor 328 requires a power ranging from 1000 Watts (W) to 10,000 W, preferably 2,000 W to 9,000 W, preferably 3,000 W to 8,000 W, preferably 4,000 W to 7,000 W, preferably 5,000 W to 6,000 W, or 5,500 W. In some embodiments, the compressor 328 operates with a condensing temperature range from 20° C. to 40° C., preferably 22.5° C. to 37.5° C., preferably 25° C. to 35° C., preferably 27.5° C. to 32.5° C., or 30° C. The condenser water loop 330 is used to cool the condenser 326 of the refrigerant loop 320. The condenser water loop 330 includes a cooling tower (not shown) to dump the heat extracted from the condenser 326 of the refrigeration loop 320 to the atmosphere.

For such a system, Coefficient of Performance (COP) may be predicted by using regression equations. Several regression equations have been proposed [See: Lee T S, Lu W C—An evaluation of empirically-based models for predicting energy performance of vapor-compression water chillers, Appl Energy 2010, 87:3486-93]. The most commonly used model is the Gordon-Ng universal model (GNU model) [See: Ng K C, Chua H T, Ong W, Lee S S, Gordon J M—Diagnostics and optimization of reciprocating chillers: theory and experiment, Appl Therm Eng 1997, 17:263-76; and Gordon J M, Ng K C—Cool thermodynamics, Cornwall: Cambridge International Science Publishing, 2008; incorporated herein by reference] as given below, $$\frac{T_{wi}}{T_{ci}}\left(1+\frac{1}{COP}\right)-1=\beta_1\frac{T_{wi}}{\dot{Q}_e}+\beta_2\frac{T_{ci}-T_{wi}}{T_{ci}\dot{Q}_e}+\beta_3\frac{\dot{Q}_e}{T_{ci}}\left(1+\frac{1}{COP}\right)\# \quad (1)$$

wherein, $T_{wi}$ is the inlet temperature of water to the evaporator of the chiller, $T_{ci}$ is the inlet temperature of water to the condenser of the chiller from the water-cooling tower, $\dot{Q}_e$ is the thermal load on the chiller, $\beta_1$, $\beta_2$ and $\beta_3$ are constants determined from experimental data using regression analysis [See: Reddy T A, Andersen K K—An evaluation of classical steady-state off-line linear parameter estimation methods applied to chiller performance data, HVAC R Res 2002, 8:101-24, incorporated herein by reference]. Herein, the values of the constants used in Equation (1) are determined using experimental data. For a set of experimental data, the values of the constants are determined using regression analysis [See: Ng et al., as discussed]. The values for the constants reported are: $\beta_1$=0.0366, $\beta_2$=26.1 and $\beta_3$=0.127.

Figure 4:
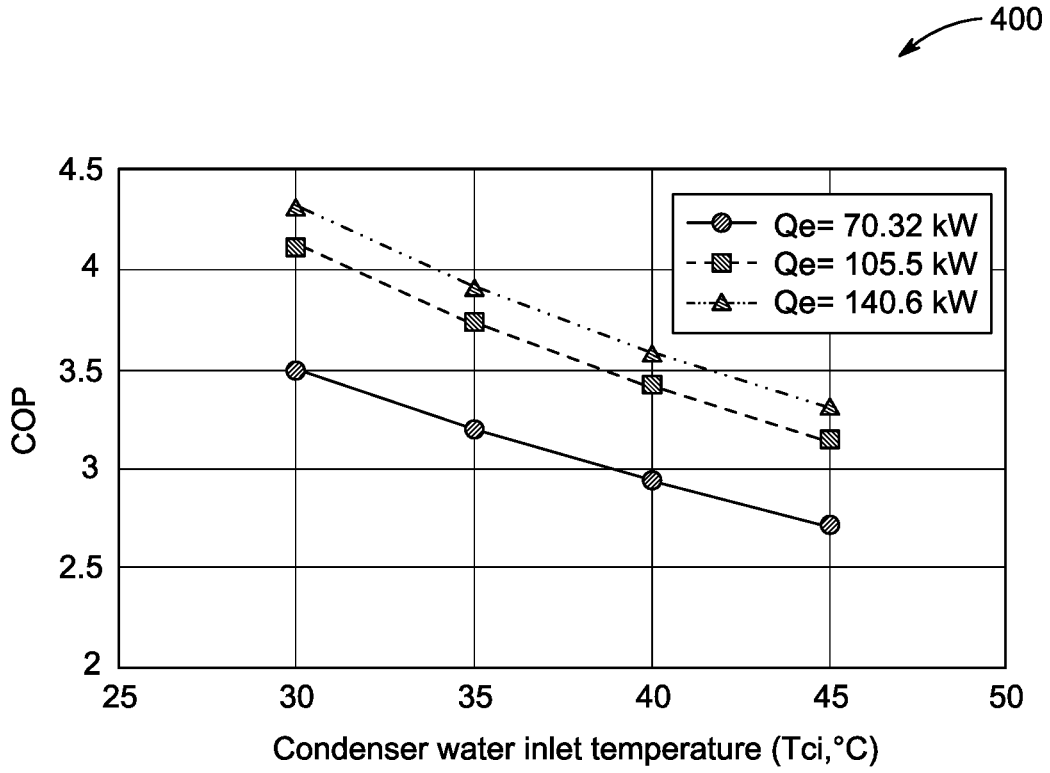
FIG. 4 is a graph depicting effect of inlet temperature of condenser water on COP of the chiller of FIG. 3, according to certain embodiments.

FIG. 4 illustrates a graph 400 depicting the effect of the inlet temperature of the condenser water on the COP of the chiller (such as, the water chiller 300 of FIG. 3), as derived from Equation (1) above. It can be seen that with an increase in the inlet temperature of the condenser water, the COP of the chiller is reduced, which in turn may reduce the cooling performance of the overall system. Such a scenario of higher condenser water inlet temperature is highly likely during the hot summer months when the temperature can reach as high as 50 C in some regions (such as in some parts of Saudi Arabia), decreasing the performance of cooling towers. Having lower COP means higher consumption of electrical power which can lead to significant cost in the long run. In other words, the objective may be to reduce the inlet temperature of the condenser water to have higher COP, which means lower consumption of electrical power, and which can lead to significant savings in the long run, as provided in the present disclosure.

In order to demonstrate the potential energy and money-saving that can arise due to a reduction of 10° C. in the condenser water inlet temperature, calculations are further carried out as discussed hereinafter. According to Electricity & Cogeneration Regulatory Authority (ECRA), Saudi Arabia produced about 289 TWh of electrical energy in the year 2019. About 75% of the produced electrical energy is consumed in the residential, government and commercial sectors. Of this, about 70% of the energy is consumed for meeting the cooling demands of these buildings. Furthermore, the weakly peak load of the electrical grid in Saudi Arabia can double to 61.743 GW from June to September in comparison to a low of 33.44 GW during the winter months of December to March. Further, a total number of houses in Saudi Arabia in the year 2004 was about 4 million and it was 4.6 million in 2010, of this about 25% are reported to be villas. This shows that the residential sector of Saudi Arabia is growing by about 108,561 households annually. Using this data, it may be estimated that the number of households in Saudi Arabia in the year 2022 to be 5.9 million. This approximates to about 1.48 million villas that are estimated to exist around the country in the year 2022. It is further assumed that the average installed cooling capacity of these villas is 30 tons (105.5 kW).

As per estimates, the net saving in compressor work when the condenser water inlet temperature is reduced from 40° C. to 30° C. for a 30-ton water-chiller is 5.23 kW. Further, it is assumed that the high condenser water inlet temperature occurs for 10 hours only for the six peak summer months. For a single villa, the annual energy saving would be about 9414 kWh annually (see Equation (2) below). The cost of electricity per unit for residential buildings in Saudi Arabia depends upon the monthly consumption. As per available information, a rate of 0.18 SAR/kWh is levied if the energy consumption is less than 6000 kWh, above which a rate of 0.3 SAR SAR/kWh is levied. A villa with a 30-ton chiller would consume more than 6000 kWh, especially during the summer months. With a 0.3 SAR/kWh electricity tariff, for the villas, the total annual monetary saving would be around 2824 SAR.

$$\text{Electricity saved/villa} = 5.23\ \text{kW} \times 10\frac{h}{\text{day}} \times 30\frac{\text{day}}{\text{month}} \times 6\ \text{months} = 9414\ \text{kWh/year}\ \# \tag{2}$$

Further, if this number is scaled to 1.48 million villas, the estimated energy saving from a reduction in temperature of 10° C. would be about 14 TWh annually, which amounts to a 4.8% reduction in the total electricity demand of Saudi Arabia. The total monetary saving would be around 4.18 billion SAR. Thus, reducing the condenser water inlet temperature of water-cooled chillers can significantly reduce energy consumption, especially during the summer months. It is worth noting that this estimate is only for residential villas. The present disclosure achieves this by the utilization of small solar assisted vapor absorption/compression cycle powered by solar energy to reduce the temperature of the water supplied to the condenser of the refrigerant cycle, especially at the peak hours in hot and humid areas, where the cooling load is the highest as well as the humidity and the temperature are at its highest levels, which reduce the cooling capacity of the chillers cooling towers. It may be appreciated that commercial and government buildings also utilize chillers for air conditioning in which the cooling capacity requirements could be in the order of 10-20 thousand tons. Thus, incorporating the teachings of the present disclosure for cooling systems in residential, as well as commercial and governmental buildings, would result in scaling of the energy savings and the monetary benefits.

Figure 5:
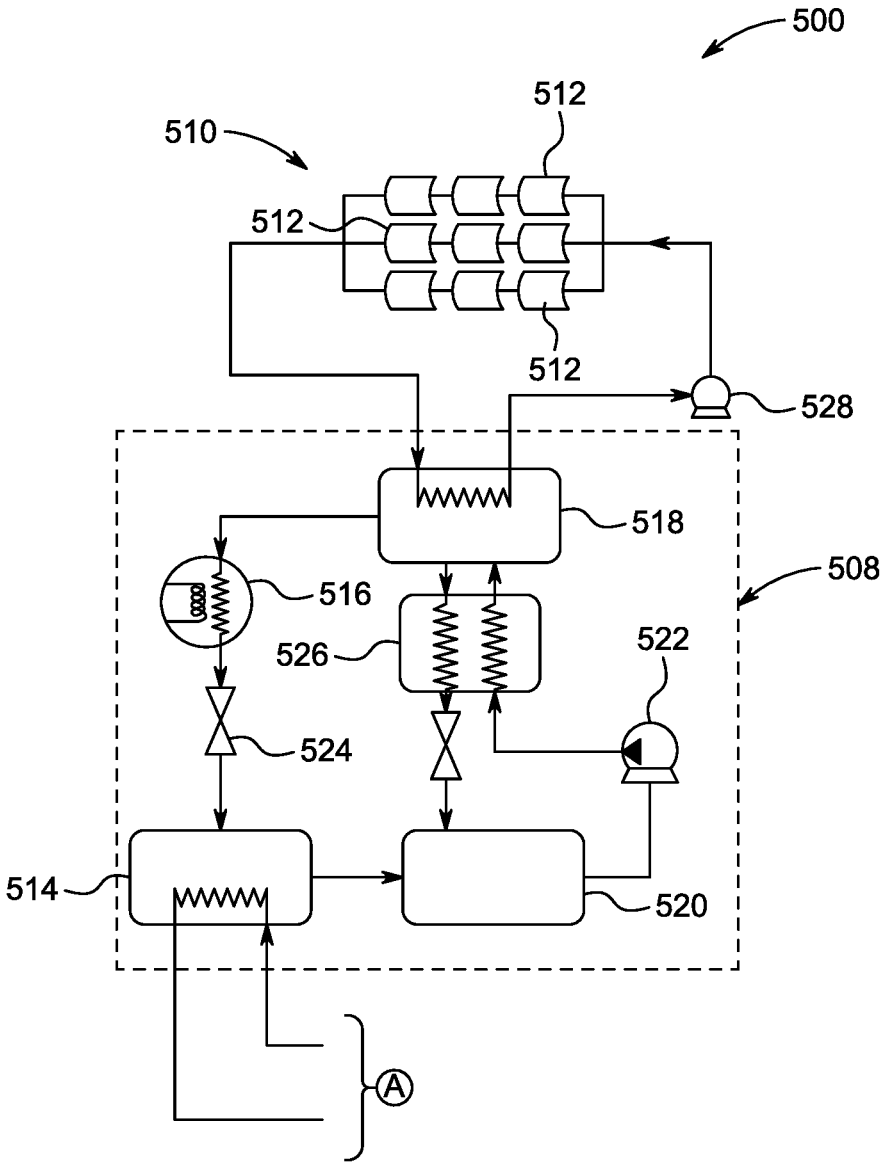
FIG. 5 is a schematic diagram of a solar augmented chilled-water cooling system, according to a first embodiment.
Figure 5:
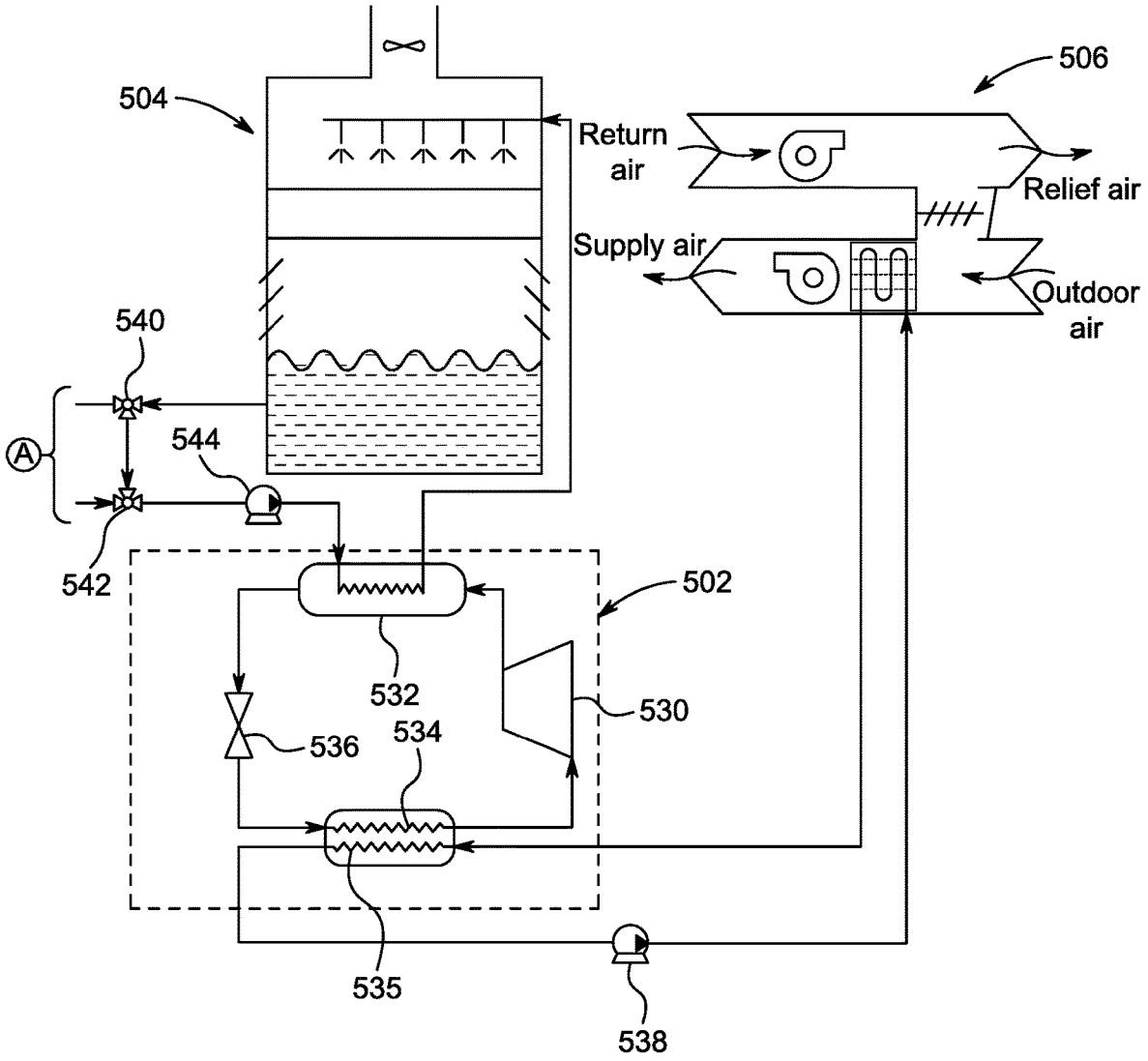

Referring to FIG. 5, illustrated is a schematic diagram of a solar augmented chilled-water cooling system (represented by reference numeral 500, and hereinafter simply referred to as "system 500"), in accordance with a first embodiment of the present disclosure and is generally similar to the water-chilled cooling system 100 of FIG. 1. As illustrated, the system 500 includes a refrigeration cycle 502 which acts as a chiller therein. In some embodiments, the refrigerant used by the chiller 120 is water. In some embodiments, the water refrigerant contains a percentage of glycol, propylene, or corrosion inhibitors. In the present embodiments, the refrigeration cycle 502 is a vapor compression system, with the two terms being interchangeably used hereinafter. The refrigeration cycle 502 may alternatively implement a vapor absorption cycle for the present purposes without departing from spirit and scope of the present disclosure. The system 500 also includes a cooling tower 504 and an air handling unit (AHU) 506. In some embodiments, the cooling tower 504 has a height of from 10 meters (m) to 150 m, preferably 20 m to 140 m, preferably 30 m to 130 m, preferably 40 m to 120 m, preferably 50 m to 110 m, preferably 60 m to 100 m, preferably 70 m to 90 m, or 90 m. In some embodiments, the cooling tower 504 has a diameter of from 10 m to 100 m, preferably 20 m to 90 m, preferably 30 m to 80 m, preferably 40 m to 70 m, preferably 50 m to 60 m, or 55 m. In some embodiments, the water level in the cooling tower 504 is maintained by a water level sensor (not shown). In some embodiments, the cooling tower 504 includes a variable speed-fan for forcing air to the chiller 120. In some embodiments, the system 100 includes multiple cooling towers 504 in series, preferably 2 to 10 towers, preferably 3 to 9 towers, preferably 4 to 8 towers, preferably 5 to 7 towers, or 6 towers. In some embodiments, the cooling tower 504 has both a first and second set of slits ranging from 3 to 20 slits, preferably 4 to 18 slits, preferably 6 to 16 slits, preferably 8 to 14 slits, preferably 10 to 12 slits, or 11 slits. In some embodiments, the first and second set of slits are angled in a range from 15° to 165° with respect to the interior wall of the cooling tower, preferably 30° to 150°, preferably 45° to 135°, preferably 60° to 120°, preferably 75° to 105°, or °. In some embodiments, the AHU 506 includes air particulate filters to filter out contaminants in the outdoor air. In some embodiments, the AHU 506 has a plurality of fans ranging from 4 to 16 fans, preferably 5 to 15 fans, preferably 6 to 14 fans, preferably 7 to 13 fans, preferably 8 to 12 fans, preferably 9 to 11 fans, or 10 fans. According to embodiments of the present disclosure, the system 500 further includes a supplemental cycle 508 to support operations of the vapor compression system 502, as discussed later in more detail. In the present system 500, as shown in FIG. 5, the supplemental cycle 508 is a vapor absorption system, with the two terms being interchangeably used hereinafter.

Further, as illustrated, the vapor absorption system 508 includes a first evaporator 514, a first condenser 516, a generator 518, an absorber 520, a first pump 522 and a first throttling valve 524. The working of the vapor absorption system 508, involving the first evaporator 514, the first condenser 516, the generator 518, the absorber 520, the first pump 522 and the first throttling valve 524, may be contemplated by a person having ordinary skill in the art of cooling systems and thus has not been described herein for the brevity of the present disclosure. In some embodiments, the first evaporator 514 contains chilled water tubes made out of steel, PVC, metal, plastic, iron, or alloys. In some embodiments, the tubes of the first evaporator 514 have a diameter of from 10 mm to 100 mm, preferably 20 mm to 90 mm, preferably 30 mm to 80 mm preferably 40 mm to 70 mm preferably 50 mm to 60 mm, or 55 mm. In some embodiments, a temperature difference between the inlet stream of the first evaporator 514 and the outlet stream of the first evaporator 514 is between 20° C. and 60° C., preferably 30° C. and 50° C., or 40° C. In some embodiments, the cool water stream sent to the first three-way valve 540 is in fluid communication with an inlet stream of the first evaporator 514. In some embodiments, an outlet stream of the first evaporator 514 is in fluid communication with a second three-way valve 542, wherein an outlet stream from the second three-way valve 542 is sent to the fourth pump 544. In some embodiments, the first condenser 516 can be cooled with air or water. In some embodiments, the first condenser 516 can accommodate a flow rate exiting generator 518 of from 1 gallon/minute to 20 gal/min, preferably 2 gal/min to 18 gal/min, preferably 4 gal/min to 16 gal/min, preferably 6 gal/min to 14 gal/min, preferably 8 gal/min to 12 gal/min, or 10 gal/min. In some embodiments, the first condenser 516 can accommodate temperatures ranging from 10° C. to 50° C., preferably 12.5° C. to 47.5° C., preferably 15° C. to 45° C., preferably 17.5° C. to 42.5° C., preferably 20° C. to 40° C., preferably 22.5° C. to 37.5° C., preferably 25° C. to 35° C., preferably 27.5° C. to 32.5° C., or 30° C. In some embodiments, the generator 518 requires a power ranging from 1000 Watts (W) to 10,000 W, preferably 2,000 W to 9,000 W, preferably 3,000 W to 8,000 W, preferably 4,000 W to 7,000 W, preferably 5,000 W to 6,000 W, or 5,500 W. In some embodiments, the compressor 518 operates with a condensing temperature range from 20° C. to 40° C., preferably 22.5° C. to 37.5° C., preferably 25° C. to 35° C., preferably 27.5° C. to 32.5° C., or 30° C. In some embodiments, the generator has a separate coil for each trough of the PTC so that each trough is looped to an individual coil of the generator. In some embodiments, there are between 3 and 9 coils for each trough, preferably between 4 and 8 coils, preferably between 5 and 7 coils, or 6 coils.

In a particularly preferred embodiment of the invention an array of parabolic trough collectors includes 3-5 rows of collectors each row having 3-5 parabolic trough collectors (not shown) arranged in a column. Preferably the PTC system 510 has an equal number of rows and columns. In a particularly preferred embodiment of the invention a hot stream outlet of the PTCs enters a manifold or header that is oriented parallel to the rows of PTCs. The last PTC in a column of PTCs has an outlet pipe which is directly connected to the manifold. The generator 518 is disposed on an opposing side of the manifold such that the manifold is integral with the generator 518. This configuration permits the fluid exiting the PTCs to maximize heat transfer to the generator 518. One or more inlet points may be present on the surface of the generator 518 in fluid communication with the manifold which is disposed lengthwise on the surface of the generator 518 to maximize contact therewith. The hot stream from the PTC outlets enters the generator 518 and passes through a coil inside the generator 518.

In some embodiments, the absorber 520 also consists of a series of tube bundles over which a strong concentration of absorbent, preferably lithium-bromide or water, is sprayed or dripped. In some embodiments, the absorber 520 has between 4 and 20 bundles, preferably 6 to 18, preferably 8 to 16, preferably 10 to 14, or 12 bundles. In some embodiments, the first pump 522 can accommodate a flow rate of from 5 gallon/minute to 40 gal/min, preferably 10 gal/min to 35 gal/min, preferably 15 gal/min to 30 gal/min, preferably 20 gal/min to 25 gal/min, or 22.5 gal/min. In some embodiments, the first pump 522 requires a power of 3000 Watts (W) to 15,000 W, preferably 4,000 W to 14,000 W, preferably 5,000 W to 13,000 W, preferably 6,000 W to 12,000 W, preferably 7,000 W to 11,000 W, preferably 8,000 W to 10,000 W, or 9,000 W. In some embodiments, the throttling valve 524 can accommodate pressures ranging from between pounds per square inch (psi) to 500 psi, preferably 100 psi to 450 psi, preferably 150 psi to 400 psi, preferably 200 psi to 350 psi, preferably 250 psi to 300 psi, or 275 psi. In some examples, the vapor absorption system 508 may further include a solution heat exchanger (SHX) 526 (as shown) which preheats the weak solution from the absorber 520 by utilizing heat from hot strong solution leaving the generator 518, again as would be contemplated by a person having ordinary skill in the art of cooling systems and thus has not been described herein. In some embodiments, the weak solution and strong solution are refrigerants, such as fluorocarbons, ammonia, water, carbon dioxide, or the like.

According to embodiments of the present disclosure, the supplemental cycle 508 is powered by a solar energy harvesting unit 510. The solar energy harvesting unit 510 may be considered part of the supplemental cycle 508 for the purposes of the present disclosure. Further, in the present system 500, the solar energy harvesting unit 510 is in the form of a parabolic trough collector (PTC) system, with the two terms being interchangeably used hereinafter. Also, as shown, the PTC system 510 includes a plurality of parabolic troughs 512 which are configured to capture solar energy for use in operations of the system 500 (as discussed later in the description). In a configuration, the plurality of parabolic troughs 512 are connected in series to each other. In another configuration, the plurality of parabolic troughs 512 are connected in parallel to each other. In other configurations, as shown in FIG. 5, the plurality of parabolic troughs 512 are connected in both series and in parallel to each other. In some embodiments, there are between 3 and 15 parabolic troughs, preferably between 4 and 14, preferably between 5 and 13, preferably between 6 and 12, preferably between 7 and 11, preferably between 8 and 10, or 9 troughs. In some embodiments, there are between 3 and 11 individual collectors in a single trough 512, preferably between 4 and 10, preferably between 5 and 9, preferably between 6 and 8, or 7 individual collectors. Each individual collector in the trough 512 has a length of from 0.2 m to 1 m, preferably 0.3 m to 0.9 m, preferably 0.4 m to 0.8 m, preferably 0.5 m to 0.7 m, or 0.6 m.

Herein, in particular, the generator 518 of the vapor absorption system 508 needs heat energy for its operation. In the present system 500, such heat energy is provided by the PTC system 510. The PTC system 510 may use the captured solar energy to heat a working fluid. In an exemplary configuration, the PTC system 510 may include at least three parabolic troughs 512, in which the working fluid is first heated in a first trough of the PTC system 510, then sent to a second trough of the PTC system 510 for gaining more heat energy, and then sent to a third trough of the PTC system 510 for gaining even more heat energy. This heated working fluid is circulated to the generator 518 via a second pump 528 for operation of the vapor absorption system 508 to generate cooling effect at the first evaporator 514 thereof. In some embodiments, the second pump 528 requires a power of 3000 Watts (W) to 15,000 W, preferably 4,000 W to 14,000 W, preferably 5,000 W to 13,000 W, preferably 6,000 W to 12,000 W, preferably 7,000 W to 11,000 W, preferably 8,000 W to 10,000 W, or 9,000 W. In the PTC system 510, the implemented working fluid may include, but is not limited to, Therminol VP-1, water, fluorocarbons, ammonia, carbon dioxide, and the like.

Further, as shown in FIG. 5, the vapor compression system 502 includes a compressor 530, a second condenser 532, a second evaporator 534 and a second throttling valve 536. The vapor compression system 502 may be used with any one of different refrigerants, including, but not limited to, R-134A, R-152A, R-717, R-410A, etc. The working of the vapor compression system 502, involving the compressor 530, the second condenser 532, the second evaporator 534 and the second throttling valve 536, to generate cooling effect at the second evaporator 534 thereof, may be contemplated by a person having ordinary skill in the art of cooling systems and thus has not been described herein for the brevity of the present disclosure. In the present system 500, the vapor compression system 502 is in fluid communication with the AHU 506. As shown, the system 500 includes a third pump 538 to pump chilled water, cooled by the cooling effect generated at the second evaporator 534, to the AHU 506. That is, a water stream exiting the second evaporator 534 is sent to the AHU 506 through the third pump 538. In some embodiments, the third pump 538 requires a power of 3000 Watts (W) to 15,000 W, preferably 4,000 W to 14,000 W, preferably 5,000 W to 13,000 W, preferably 6,000 W to 12,000 W, preferably 7,000 W to 11,000 W, preferably 8,000 W to 10,000 W, or 9,000 W.

In the system 500, the AHU 506 provides cooling effect to a closed space (such as, interior of a building) by using the chilled water to absorb heat therein, and in return generate heated water. This heated water is passed back to the second evaporator 534 of the vapor compression system 502. That is, the water stream is returned to the second evaporator 534 after being exposed to a supplied air stream in the AHU 506. In a configuration, as shown in FIG. 5, the second evaporator 534 includes a second heat exchanger 535 to re-cool the received heated water thereat to be passed back to the AHU 506 for continuous cooling of the said closed space. In certain embodiments, the second heat exchanger is a shell and tube heat exchanger or a tube in tube heat exchanger. In such configuration, the second heat exchanger 535 of the second evaporator 534 is in fluid communication with the AHU 506. The second heat exchanger 535 is fluidically connected to the AHU 506 to exchange heat with an air stream returning from the AHU 506. The above described working of the AHU 506 has been explained in detail in reference to the water-chilled cooling system 100 of FIG. 1 and thus not repeated herein for the brevity of the present disclosure.

In the vapor compression system 502, the refrigerant in the second evaporator 534 extracts heat from the heated water for its said re-cooling. Thereby, the second condenser 532 needs to dissipate heat from the refrigerant to keep its condenser water inlet temperature in check (as discussed) for efficient operation of the present system 500. Now, in general, the second condenser 532 of the vapor compression system 502 is cooled using the cooling tower 504 that provides water at temperatures close to the wet-bulb temperature of the ambient air at the vicinity of the cooling. In some embodiments, a hot outlet stream from the second condenser 532 connects to an inlet of the cooling tower, and a cool water stream from the cooling tower 504 goes to a first three-way valve 540. The water in the cooling tower 504 is cooled by evaporative cooling while passing therethrough (as discussed in reference to FIG. 1, as thus not repeated herein). In a configuration, the cooling tower 504 includes a set of slits (as shown, not labelled). The cool air from an atmosphere enters the cooling tower 504 through the set of slits. In some examples, the cooling tower 504 may include a plurality of chillers (not shown), and a plurality of tubes (not shown) to transfer a coolant fluid to the plurality of chillers. In some embodiments, there are between 5 and 20 chillers, preferably between 6 and 19, preferably between 7 and 18, preferably between 8 and 17, preferably between 9 and 16, preferably between 10 and 15, preferably between 11 and 14, or 12 chillers. In some embodiments, there are between 2 and 12 tubes, preferably between 3 and 11, preferably between 4 and 10, preferably between 5 and 9, preferably between 6 and 8, or 7 tubes. In a configuration, optionally, a water stream exiting the cooling tower 504 may be used to cool the PTC system 510 without any limitations.

As shown in FIG. 5, the cooling tower 504 is in fluid communication with the vapor absorption system 508. Herein, a water stream from the cooling tower 504 is returned to the first evaporator 514 of the vapor absorption system 508. Further, as shown, the vapor absorption system 508 is in fluid communication with the vapor compression system 502 via a fourth pump 544. In some embodiments, the fourth pump 544 requires a power of 3000 Watts (W) to 15,000 W, preferably 4,000 W to 14,000 W, preferably 5,000 W to 13,000 W, preferably 6,000 W to 12,000 W, preferably 7,000 W to 11,000 W, preferably 8,000 W to 10,000 W, or 9,000 W. In the present system 500, the chilled water from the cooling tower 504 may first be further cooled by the first evaporator 514 of the vapor absorption system 508 before being supplied to the second condenser 532. In particular, the chilled water from the cooling tower 504 is passed to the first evaporator 514 of the vapor absorption system 508 to be further cooled using the generated cooling effect thereat. Thereafter, a water stream exiting the first evaporator 514 is sent to the second condenser 532. Further, as shown, the vapor compression system 502 is in fluid communication with the cooling tower 504. Herein, the water stream exiting the second condenser 532 is returned to the cooling tower 504 to be re-chilled therein via evaporation process (as discussed). Thus, it may be appreciated that the working of the present system 500 is different than the water-chilled cooling system 100 of FIG. 1, in which the chilled water from the cooling tower 110 is directly supplied to the condenser 124 of the water cooled chiller 120 (i.e., the vapor compression cycle thereof).

Further, as shown in FIG. 5, in the present system 500, the cooling tower 504 is in fluid communication with the vapor absorption system 508 through a first three-way valve 540. Specifically, the cooling tower 504 is in fluid communication with the vapor absorption system 508 though two three-way valves, namely a first three-way valve 540 and a second three-way valve 542. Herein, the water stream exiting the cooling tower 504 leaves through the first three-way valve 540. Further, the water sent through the first three-way valve 540 is returned to the first evaporator 514. It may be understood that the water from the cooling tower 504 may reach the second condenser 532 of the vapor compression system 502 via two routes:

(i) In moderate temperature and humidity conditions, the chilled water from the cooling tower 504 may be passed through the valves 540, 542 directly to reach the second condenser 532 of the vapor compression system 502.

(ii) During high temperature and humidity conditions (and usually at peak cooling loads), the water from the cooling tower 504 passes through the first three-way valve 540 and then it goes through the first evaporator 514 of the vapor absorption system 508 in which it gets further cooled. The further cooled chilled water from the first evaporator 514 then passes through the second three-way valve 542 to reach the second condenser 532 of the vapor compression system 502 at required low temperature for its efficient operation. That is, the water stream exiting the first evaporator 514 is sent through the second three-way valve 542, and the water stream exiting the second three-way valve 542 is sent through the fourth pump 544 to the second condenser 532.

In other examples, the valves 540, 542 also enables to only transfer a small amount of the chilled water from the cooling tower 504 to pass to the first evaporator 514 of the vapor absorption system 508, while the rest may be passed from the valves 540, 542 directly, thus providing control on the degree of the condenser water inlet temperature at the second condenser 532 of the vapor compression system 502.

Thus, the system 500 as per the first embodiment of the present disclosure provides that the cooling system 100 (FIG. 1) is modified by adding the solar energy harvesting unit 510 to assist the vapor absorption system 508 to further cool the chilled water coming out from the cooling tower 504 during hot and humid summer days. This helps to keep the condenser water inlet temperature at the condenser 532 of the refrigeration cycle 502 in check to allow for efficient operation of the system 500. It may be appreciated that although the above examples have been described in terms of working fluid being water; in other examples, the working fluid may be brine solution, ammonia solution (ammonia-water), LiBr solution, and the like without any limitations. In some embodiments, the system 500 includes a second vapor compression system which comprises six three-way valves to exchange heat with the AHU 506.

Figure 6:
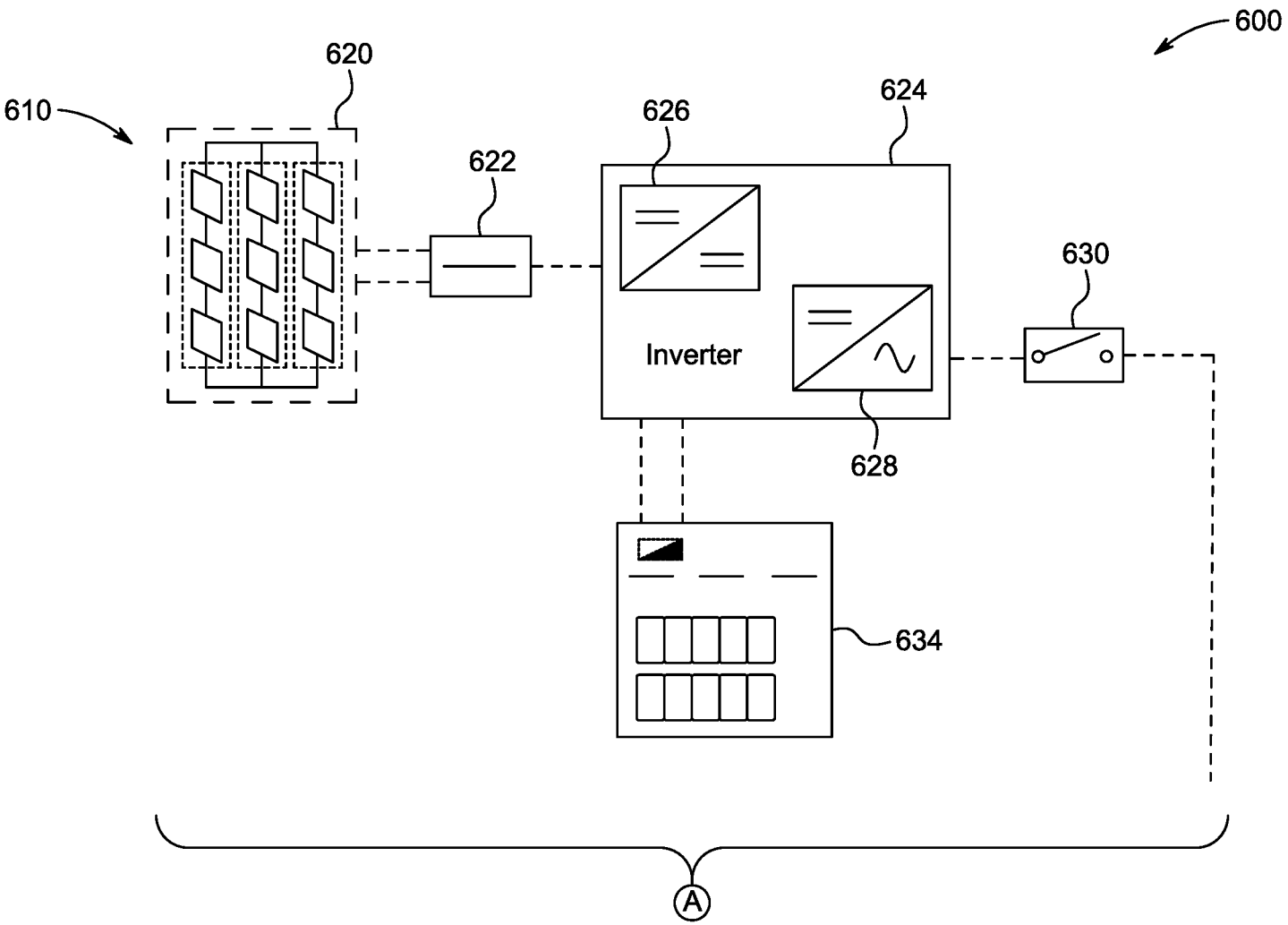
FIG. 6 is a schematic diagram of a solar augmented chilled-water cooling system, according to a second embodiment.
Figure 6:
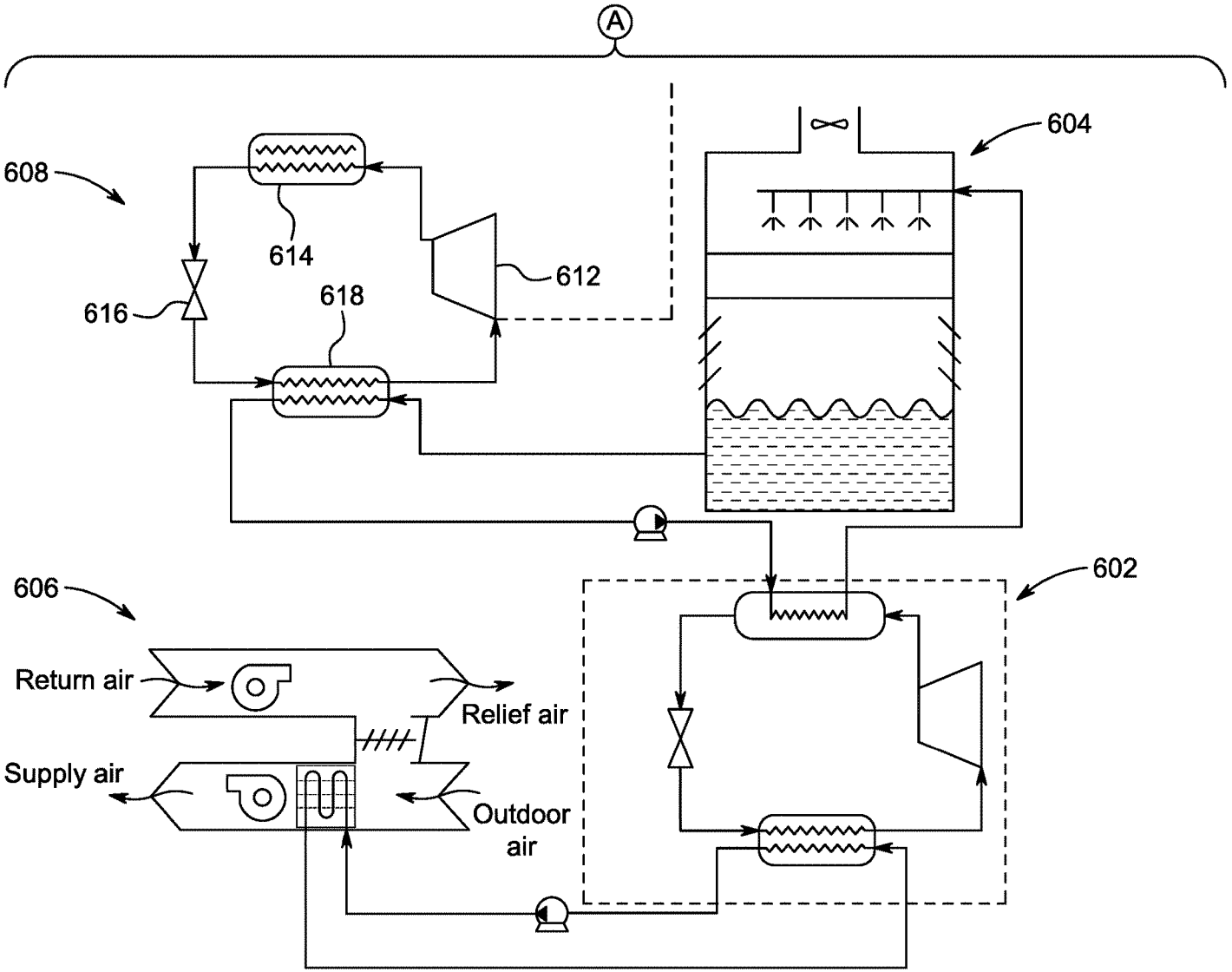

Referring to FIG. 6, illustrated is a schematic diagram of a solar augmented chilled-water cooling system (represented by reference numeral 600, and hereinafter simply referred to as "system 600"), in accordance with a second embodiment of the present disclosure and is generally similar to the water-chilled cooling system 100 of FIG. 1. As illustrated, similar to the system 500 as discussed in the preceding paragraphs, the system 600 also includes a refrigeration cycle 602, a cooling tower 604, an air handling unit (AHU) 606, a supplemental cycle 608 and a solar energy harvesting unit 610. In the present system 600, the supplemental cycle 608 is a vapor compression system (instead of vapor absorption system 508 of the system 500 of FIG. 5), with the two terms being interchangeably used hereinafter. As shown, the vapor compression system 608 includes a compressor 612, a condenser 614, a throttling valve 616 and an evaporator 618. As may be understood by a person skilled in the art, the vapor compression system 608, or specifically the compressor 612 therein, is powered by electric energy (instead of heat energy, as in the vapor absorption system 508 of the system 500 of FIG. 5). Therefore, in the present system 600, the solar energy harvesting unit 610 is configured to generate the electric energy to power the vapor compression system 608. In certain embodiments, the solar energy harvesting unit 610 generates 1000 kWh to 10,000 kWh of electricity, preferably 2,000 kWh to 9,000 kWh, preferably 3,000 kWh to 8,000 kWh, preferably 4,000 kWh to 7,000 kWh, preferably 5,000 kWh to 6,000 kWh, or 5,500 kWh.

For this purpose, the solar energy harvesting unit 610 includes a plurality of photovoltaic (PV) cells 620. Herein, the PV cells 620 are in the form of PV panels, with the two terms being interchangeably used hereinafter. In a configuration, the solar energy harvesting unit 610 includes a plurality of PV panels and each PV panel contains a plurality of photovoltaic cells 620. In a configuration, each PV panel contains at least three photovoltaic cells 620. In some embodiments, the panel contains between 4 and 20 cells 620, preferably 6 to 18 cells, preferably 8 to 16 cells, preferably 10 to 14 cells, or 12 cells. In a configuration, the plurality of PV panels 620 are connected in parallel to each other. In another configuration, the plurality of PV panels 620 are connected in series to each other. In other configurations, as shown in FIG. 6, the plurality of PV panels 620 are connected in both series and in parallel to each other. The solar energy harvesting unit 610 further includes a power conditioning unit 624 with a charge regulator 626, an inverter 628, and a battery storage 634. Herein, the battery storage 634 is employed so that the system 600 can operate even during hours of low solar radiation. Further, as shown in FIG. 6, the power conditioning unit 624 is connected a DC connect 622 and an AC connect 630 to supply power to the vapor compression system 608. Such electrical arrangement may be contemplated by a person having ordinary skill in the art and thus has not been explained in detail herein, for the brevity of the present disclosure.

Thus, the system 600 as per the second embodiment of the present disclosure provides that the cooling system 100 (such as, the water-chilled cooling system 100 of FIG. 1) is modified by adding the solar energy harvesting unit 610 to assist the vapor compression system 608 to further cool the chilled water coming out from the cooling tower 604 during hot and humid summer days. This helps to keep condenser water inlet temperature at a condenser (not labelled) of the refrigeration cycle 602 in check to allow for efficient operation of the system 600.

Figure 7:
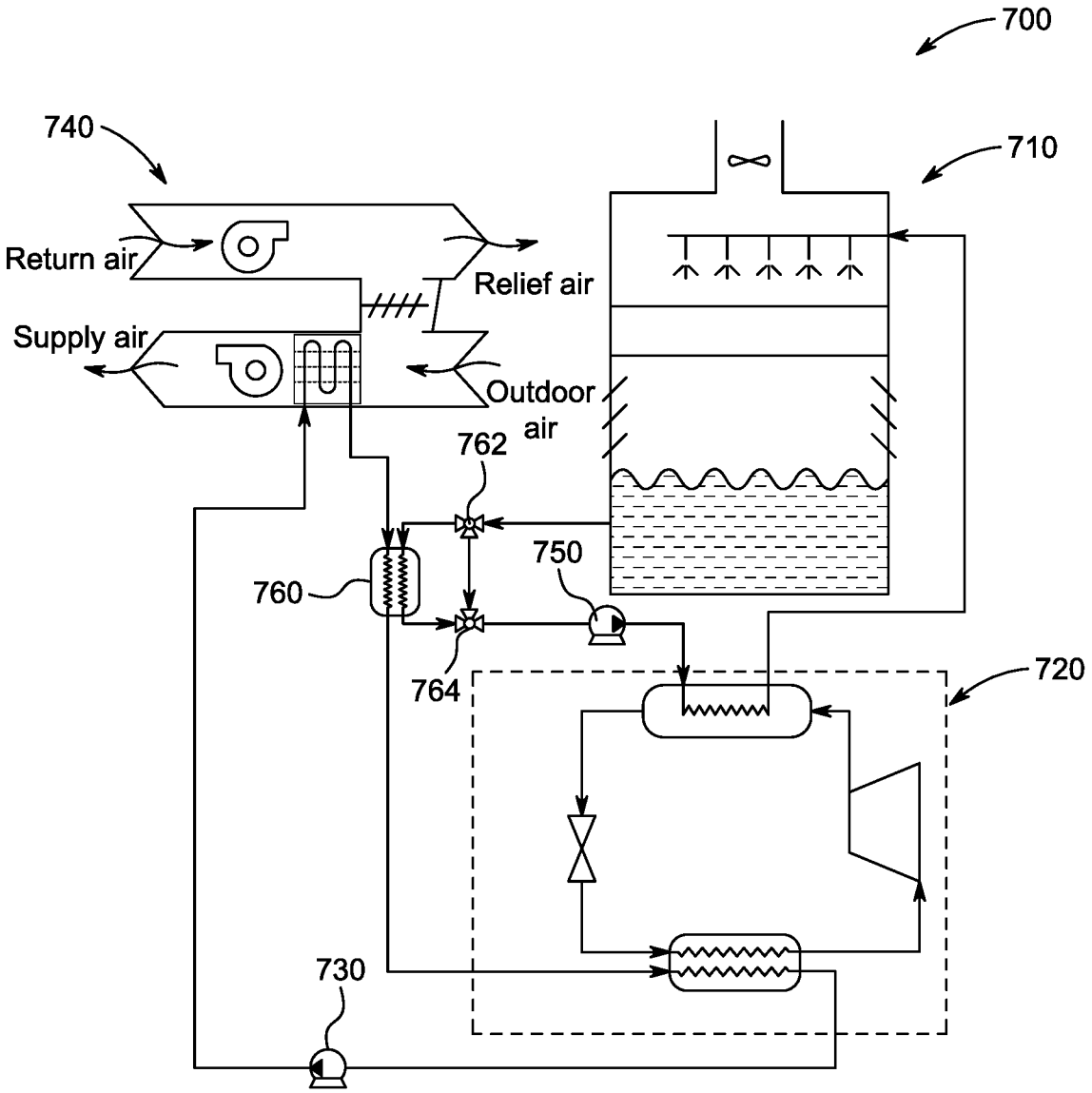
FIG. 7 is a schematic diagram of a modified water-chilled cooling system, according to a third embodiment.

Referring to FIG. 7, illustrated is a schematic diagram of a cooling system (represented by reference numeral 700), in accordance with certain embodiments of the present disclosure. As illustrated, the cooling system 700 is generally similar to the water-chilled cooling system 100 of FIG. 1, and includes a cooling tower 710, a vapor compression cycle 720 (which is a water cooled chiller), a pump 730, an AHU 740 and another pump 750. In contrast to the water-chilled cooling system 100 of FIG. 1, the system 700 additionally includes a heat exchanger 760 and two three-way valves, namely a first three-way valve 762 and a second three-way valve 764. During hot and humid summer days, the heat exchanger 760 enables the water coming out from the cooling tower 710 to reject heat to the return water from the AHU 740 which is generally at a lower temperature than the ambient. The AHU 740 has the chilled water flowing through the cooling system 700, which is cooled by the vapor compression cycle 720. The vapor compression cycle 720 can be used with different refrigerants such as R-134A, R-152A, R-717, R-410A, etc. The condenser of the vapor compression cycle 720 is cooled using the cooling tower 710 that provides water at temperatures close to the wet-bulb temperature of the ambient air at the vicinity thereof. The water in the cooling tower 710 is cooled by evaporative cooling while passing therethrough. The two three-way valves 762 and 764 are added to route the water through the heat exchanger 760 or allow it to pass directly to the condenser of the vapor compression cycle 720. Thereby, the water from the cooling tower 710 may reach the condenser of the vapor compression cycle 720 via two routes:

(i) In moderate temperature and humidity conditions, the water from the cooling tower 710 passes through the valves 762, 764 directly to reach the condenser of the vapor compression cycle 720.

(ii) During high temperature and humidity conditions (and usually at peak cooling loads), the water from the cooling tower 710 passes through first three-way valve 762 and then it goes through the heat exchanger 760 in which the water from the cooling tower 710 exchanges heat with the chilled water returning from the AHU 740. Herein, the cooled water gets more cooled while it is passing through the heat exchanger 760, then it passes through the second three-way valve 764 to reach the condenser of the vapor compression cycle 720 at proper temperature.

In other examples, the valves 762, 764 also make it possible for only a small amount of water to pass to the heat exchanger 760 while the rest passes from the first three-way valve 762 to the second three-way valve 764 directly. In some embodiments, the valves 762 and 764 can accommodate a flow rate of from 1 gallon/minute to 10 gal/min, preferably 2 gal/min to 9 gal/min, preferably 3 gal/min to 8 gal/min, preferably 4 gal/min to 7 gal/min, preferably 5 gal/min to 6 gal/min, or 5.5 gal/min.

Figure 8:
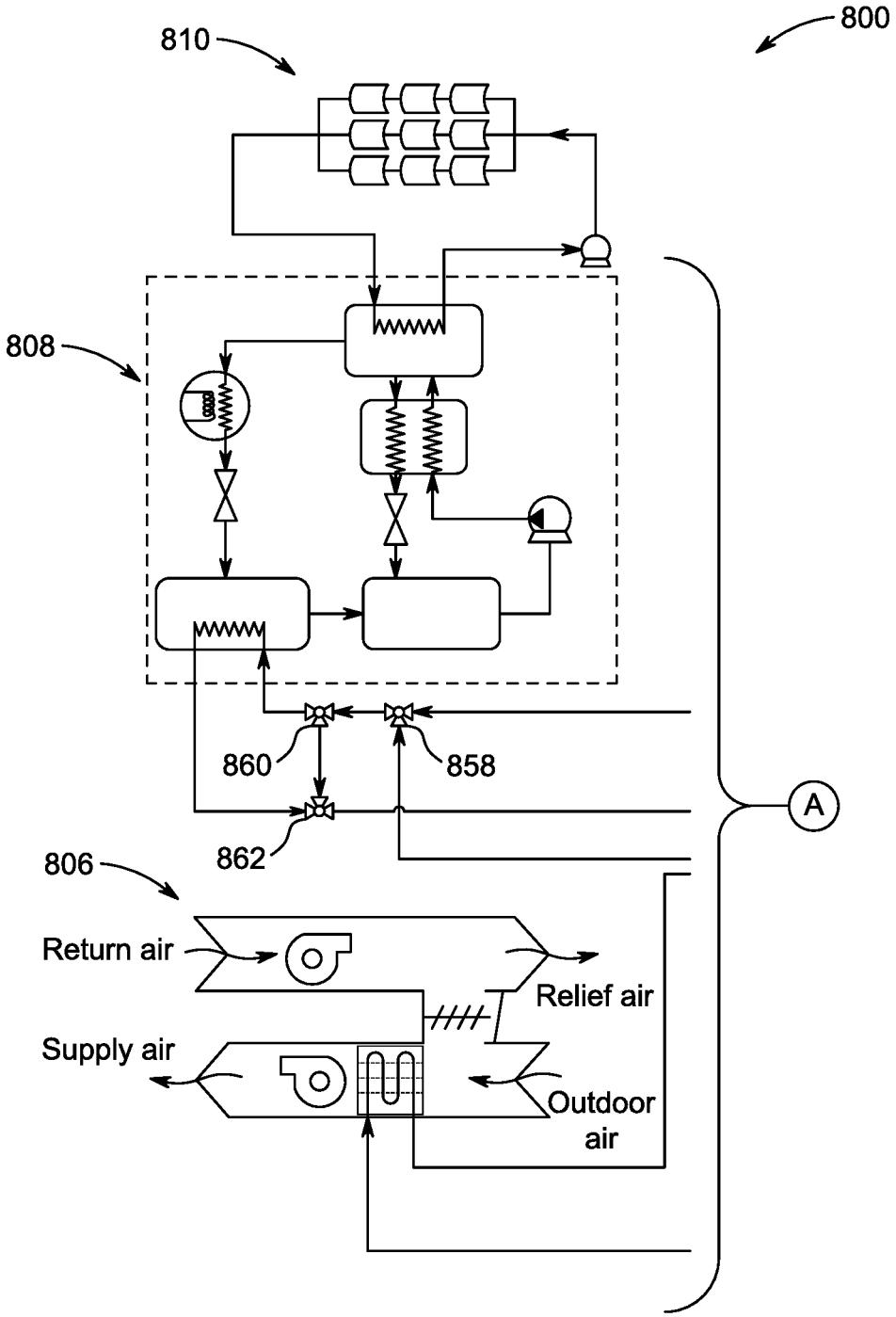
FIG. 8 is a schematic diagram of a solar augmented chilled-water cooling system, according to a fourth embodiment.
Figure 8:
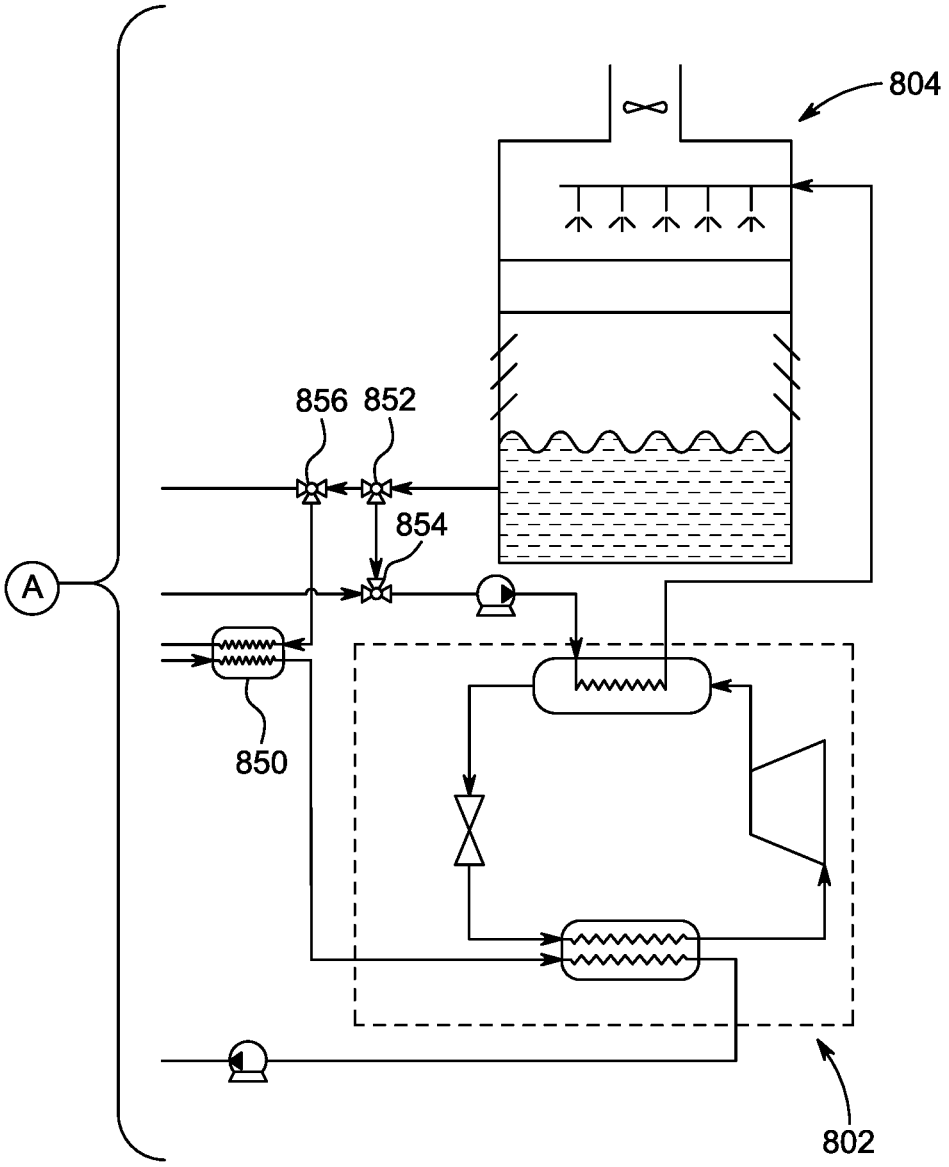

Referring to FIG. 8, illustrated is a schematic diagram of a solar augmented chilled-water cooling system (represented by reference numeral 800, and hereinafter simply referred to as "system 800"), in accordance with a third embodiment of the present disclosure. As illustrated, similar to the system 800 is generally similar to the water-chilled cooling system 100 of FIG. 1 as discussed in the preceding paragraphs, the system 800 also includes a refrigeration cycle 802, a cooling tower 804, an air handling unit (AHU) 806, a supplemental cycle 808 and a solar energy harvesting unit 810. In the present system 800, the refrigeration cycle 802 is a vapor compression system (similar to the system 500), with the two terms being interchangeably used hereinafter. Further, the supplemental cycle 808 is a vapor absorption system (similar to the system 500), with the two terms being interchangeably used hereinafter. Furthermore, the solar energy harvesting unit 810 is in the form of a parabolic trough collector (PTC) system (similar to the system 500), with the two terms being interchangeably used hereinafter. In contrast to the system 500 of FIG. 5, the system 800 additionally includes a heat exchanger 850 and six three-way valves, namely a first three-way valve 852, a second three-way valve 854, a third three-way valve 856, a fourth three-way valve 858, a fifth three-way valve 860 and a seventh three-way valve 862. In some embodiments, the valves 852, 854, 856, 858, 860, and 862 can accommodate a flow rate of from 1 gallon/minute to 10 gal/min, preferably 2 gal/min to 9 gal/min, preferably 3 gal/min to 8 gal/min, preferably 4 gal/min to 7 gal/min, preferably 5 gal/min to 6 gal/min, or 5.5 gal/min.

In the system 800, the vapor absorption system 808 is powered by the solar energy harvesting unit 810. During hot and humid summer conditions, the water from the cooling tower 804 may be further cooled by the vapor absorption system 808 or the heat exchanger 850, which enables the water coming out from the cooling tower 804 to reject heat to the return water from the AHU 806 which is generally at a lower temperature than the ambient. The six three-way valves 852, 854, 856, 858, 860, 862 are added to route the water through the heat exchanger 850 and/or through the vapor absorption system 808, or allow it to pass directly to the condenser of the vapor compression system 802. The AHU 806 has chilled water flowing through the system 800, which is cooled by the vapor compression system 802. The vapor compression system 802 may be used with different refrigerants, such as R-134A, R-152A, R-717, R-410A, etc. without any limitations. The vapor compression system 802 is cooled using water from the cooling tower 804. The six three-way valves 852, 854, 856, 858, 860, 862 are used to control the flow of water from the cooling tower 804 to the condenser of the vapor compression system 802. The water from the cooling tower 804 may reach the condenser of the vapor compression cycle 802 by:

(i) In moderate temperature and humidity conditions, passing through the valves 852 and 854 as a direct passage to be used.

(ii) During high temperature and humidity conditions (and usually at peak cooling loads), passing through the valves 852 and 856 into heat exchanger 850, where it rejects heat to the returning chilled water from the AHU 806. The water from the heat exchanger 850 then proceeds to pass through the valves 858, 860, 862 and 852 to reach the condenser of the vapor compression system 802 at proper design temperature.

(iii) Alternatively, during high temperature and humidity conditions (and usually at peak cooling loads), passing through the valves 852 and 856 into the heat exchanger 850, where it rejects heat to the returning refrigerant from the AHU 806. The water from the heat exchanger 850 then proceeds to pass through the valves 858 and 860 to reach the evaporator of the vapor absorption system 808 where it further rejects heat. It then passes through the valves 862 and 852 to reach the condenser of the vapor compression system 802 at proper design temperature.

(iv) Still alternatively, during high temperature and humidity conditions (and usually at peak cooling loads), passing through the valves 852, 856, 858 and 860 into the evaporator of the vapor absorption system 808 where it rejects heat to the working fluid. It then passes through the valves 862 and 852 to reach the condenser of the vapor compression system 802 at proper design temperature.

Figure 9:
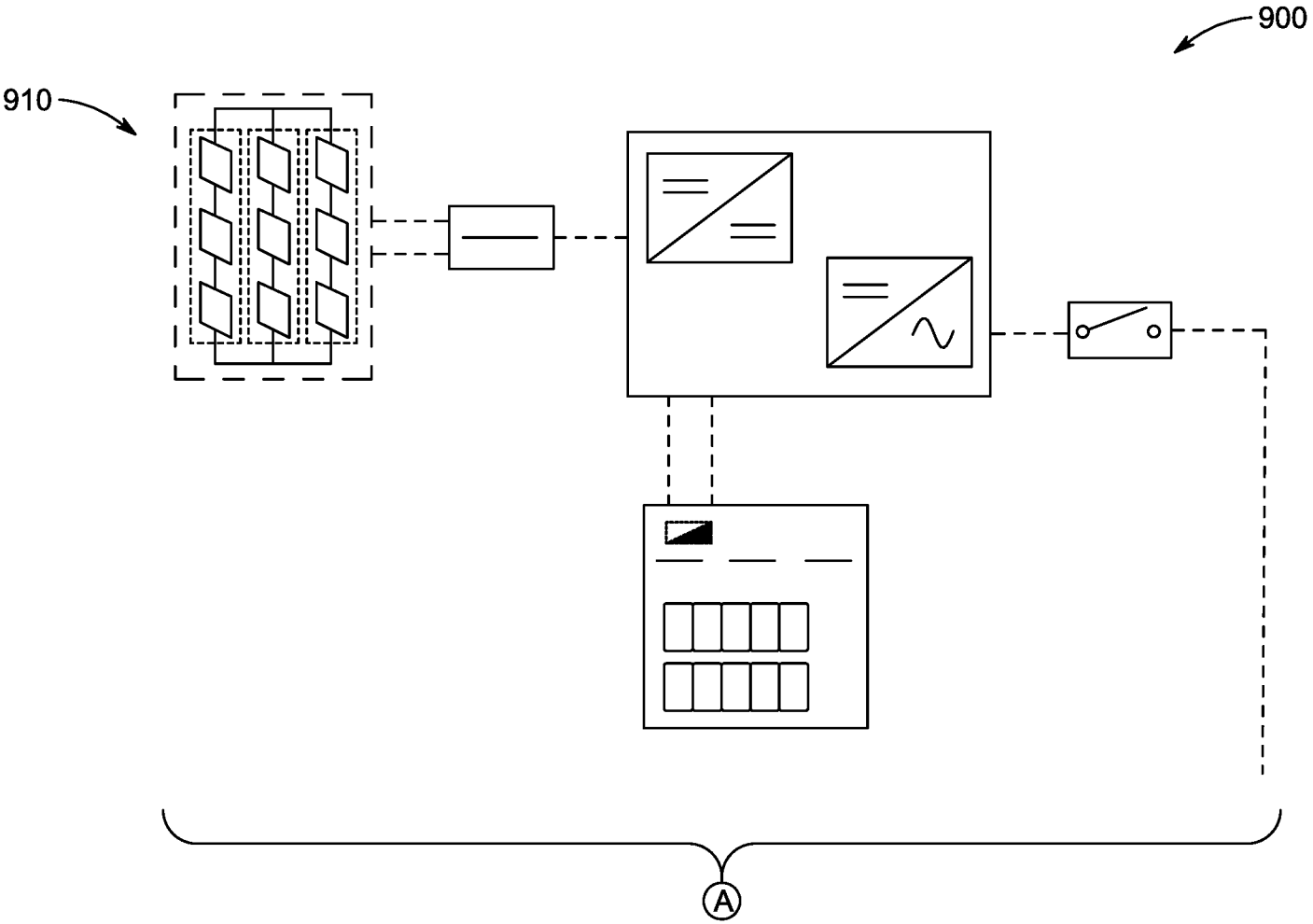
FIG. 9 is a schematic diagram of a solar augmented chilled-water cooling system, according to a fifth embodiment.
Figure 9:
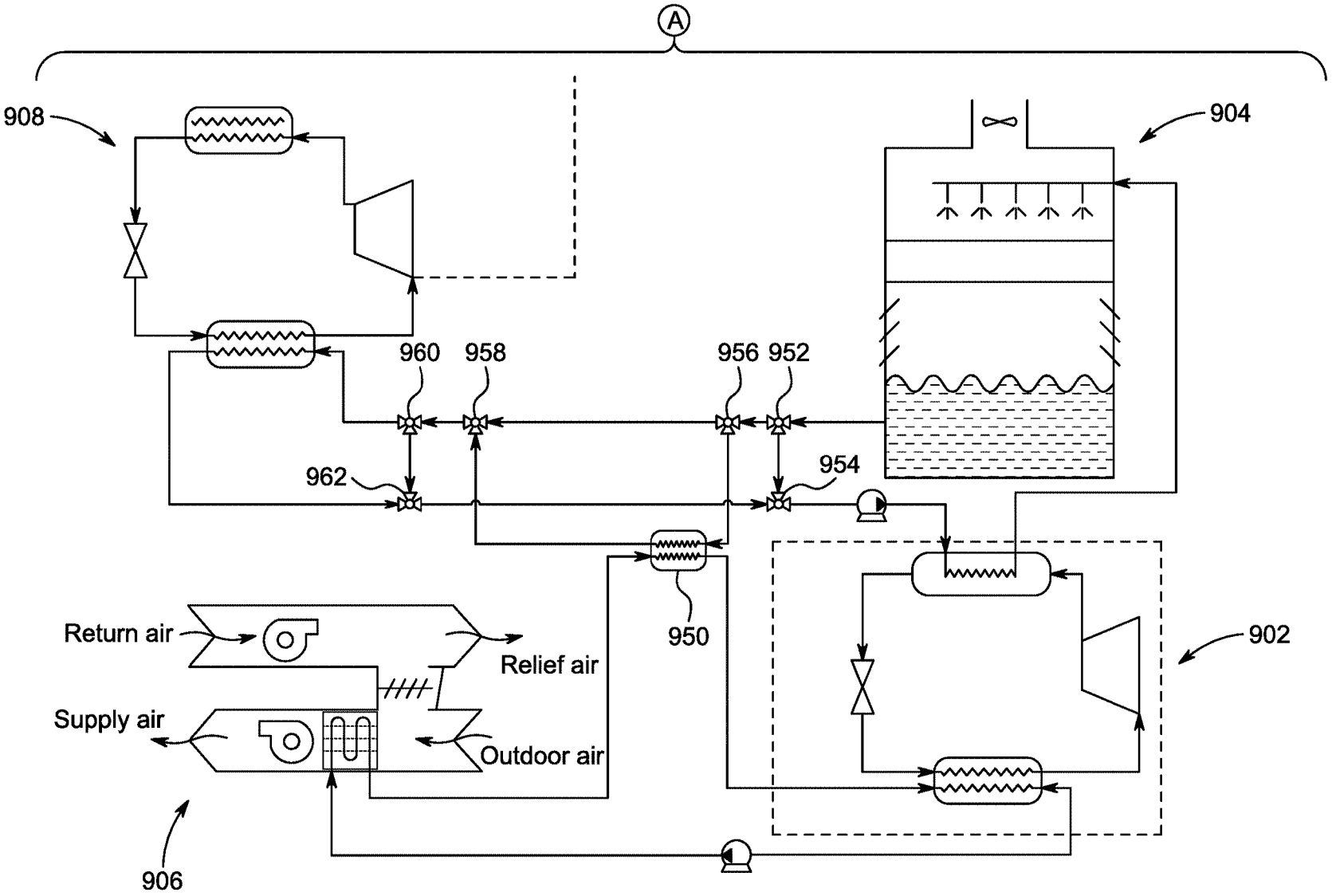

Referring to FIG. 9, illustrated is a schematic diagram of a solar augmented chilled-water cooling system (represented by reference numeral 900, and hereinafter simply referred to as "system 900"), in accordance with a fourth embodiment of the present disclosure. As illustrated, similar to the system 600 as discussed in the preceding paragraphs, the system 900 also includes a refrigeration cycle 902, a cooling tower 904, an air handling unit (AHU) 906, a supplemental cycle 908 and a solar energy harvesting unit 910. In the present system 900, the refrigeration cycle 902 is a vapor compression system (similar to the system 600), with the two terms being interchangeably used hereinafter. Further, the supplemental cycle 908 is a vapor compression system (similar to the system 600), with the two terms being interchangeably used hereinafter. Furthermore, the solar energy harvesting unit 910 includes a plurality of photovoltaic (PV) cells (similar to the system 600). In contrast to the system 600 of FIG. 6, the system 900 additionally includes a heat exchanger 950 and six three-way valves, namely a first three-way valve 952, a second three-way valve 954, a third three-way valve 956, a fourth three-way valve 958, a fifth three-way valve 960 and a seventh three-way valve 962. In some embodiments, the valves 952, 954, 956, 958, 960, and 962 can accommodate a flow rate of from 1 gallon/minute to 10 gal/min, preferably 2 gal/min to 9 gal/min, preferably 3 gal/min to 8 gal/min, preferably 4 gal/min to 7 gal/min, preferably 5 gal/min to 6 gal/min, or 5.5 gal/min.

In the system 900, the vapor compression system 908 is powered by the solar energy harvesting unit 910. During hot and humid summer conditions, the water from the cooling tower 904 may be further cooled by the vapor compression system 908 or the heat exchanger 950, which enables the water coming out from the cooling tower 904 to reject heat to the return water from the AHU 906 which is generally at a lower temperature than the ambient. The six three-way valves 952, 954, 956, 958, 960, 962 are added to route the water through the heat exchanger 950 and/or through the vapor compression system 908, or allow it to pass directly to the condenser of the vapor compression system 902. The AHU 906 has chilled water flowing through the system 900, which is cooled by the vapor compression system 902. The vapor compression system 902 may be used with different refrigerants, such as R-134A, R-152A, R-717, R-410A, etc. without any limitations. The vapor compression system 902 is cooled using water from the cooling tower 904. The six three-way valves 952, 954, 956, 958, 960, 962 are used to control the flow of water from the cooling tower 904 to the condenser of the vapor compression system 902. The water from the cooling tower 904 may reach the condenser of the vapor compression cycle 902 by:

(i) In moderate temperature and humidity conditions, passing through the valves 952 and 954 as a direct passage to be used.

(ii) During high temperature and humidity conditions (and usually at peak cooling loads), passing through the valves 952 and 956 into heat exchanger 950, where it rejects heat to the returning chilled water from the AHU 906. The water from the heat exchanger 950 then proceeds to pass through the valves 958, 960, 962 and 952 to reach the condenser of the vapor compression system 902 at proper design temperature.

(iii) Alternatively, during high temperature and humidity conditions (and usually at peak cooling loads), passing through the valves 952 and 956 into the heat exchanger 950, where it rejects heat to the returning refrigerant from the AHU 906. The water from the heat exchanger 950 then proceeds to pass through the valves 958 and 960 to reach the evaporator of the vapor compression system 908 where it further rejects heat. It then passes through the valves 962 and 952 to reach the condenser of the vapor compression system 902 at proper design temperature.

(iv) Still alternatively, during high temperature and humidity conditions (and usually at peak cooling loads), passing through the valves 952, 956, 958 and 960 into the evaporator of the vapor compression system 908 where it rejects heat to the working fluid. It then passes through the valves 962 and 952 to reach the condenser of the vapor compression system 902 at proper design temperature.

The solar augmented chilled-water cooling systems 500, 600, 800, 900 of the present disclosure are designed to be implemented in large building or district HVAC systems. The solar augmented chilled-water cooling systems 500, 600, 800, 900 provide a solution to address the issue at the peak load during summer hot and humid days by use of vapor absorption cycle or vapor compression cycle that utilizes solar energy to reduce the inlet temperature of the condenser water, resulting in improved efficiency even during hot and humid conditions. This will lower the peak demand on the national grid. Furthermore, the proposed solar augmented chilled-water cooling systems 500, 600, 800, 900 are simple enough to be incorporated with existing chilling units requiring little modifications. The present solar augmented chilled-water cooling systems 500, 600, 800, 900 may utilize a controller operable to open or close three-way valves to communicate a portion of fluid from the cooling tower for cooling purposes (as described). In particular, the controller may receive a plurality of measurements from sensors (not shown) to determine an optimal division of flow rates in the three-way valves to be conveyed directly to the chiller or to the heat exchanger in communication with the extracted return water to the AHU.

Figure 10:
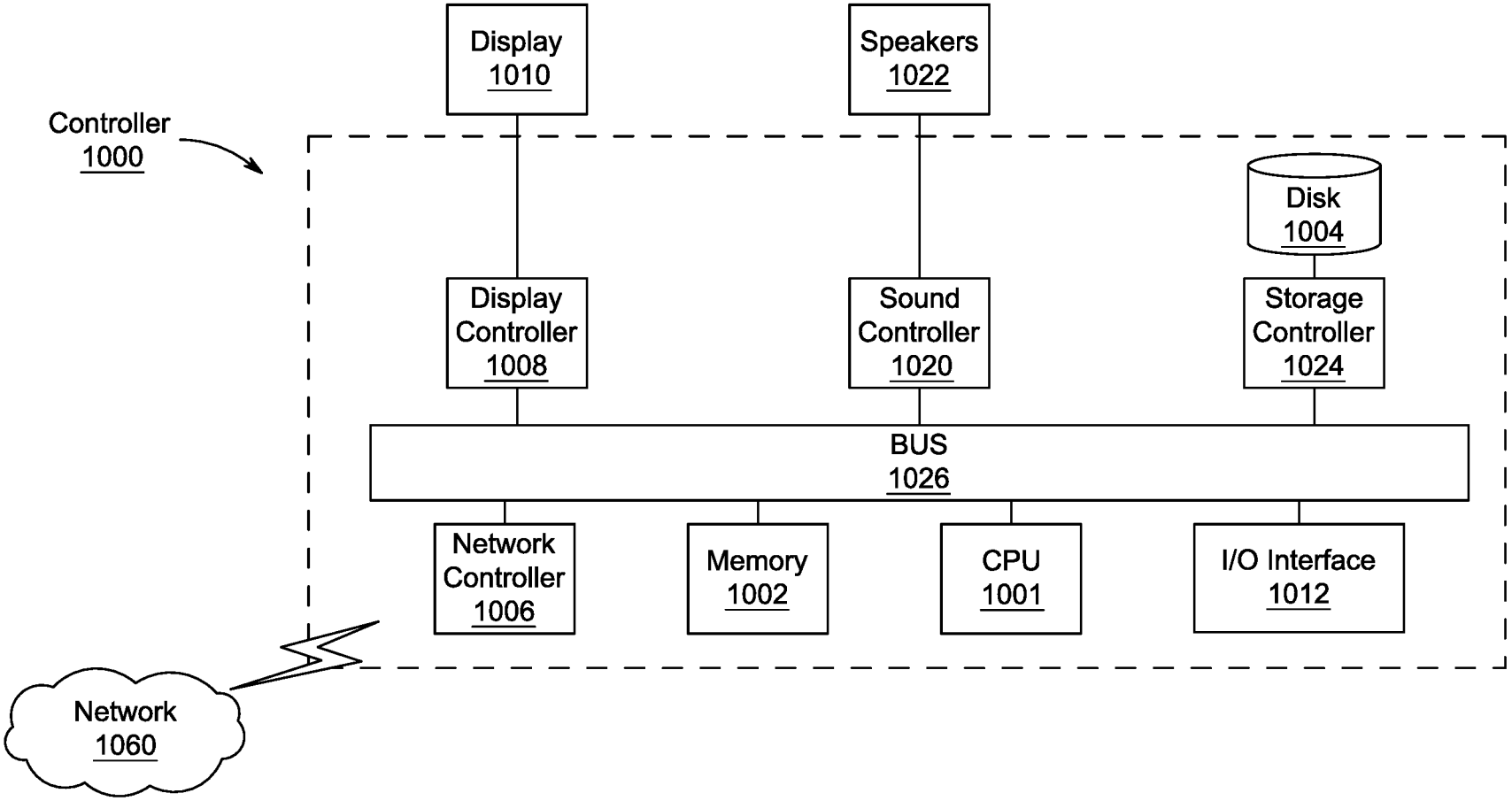
FIG. 10 is an illustration of a non-limiting example of details of computing hardware for a controller, according to certain embodiments.

Further details of hardware description for a controller 1000 according to exemplary embodiments is described with reference to FIG. 10. In FIG. 10, the controller 1000 is described to include a CPU 1001 which performs the processes described above/below.

As illustrated in FIG. 10, the process data and instructions may be stored in a memory 1002. These processes and instructions may also be stored on a storage medium disk 1004 such as a hard drive (HDD) or portable storage medium or may be stored remotely. Such storage medium disk 1004 may be any non-transitory computer-readable storage medium which stores a program executable by at least one processor to perform the described functions in the preceding paragraphs. It may be appreciated that the claims are not limited by the form of the computer-readable media on which the instructions of the inventive process are stored. For example, the instructions may be stored on CDs, DVDs, in FLASH memory, RAM, ROM, PROM, EPROM, EEPROM, hard disk or any other information processing device with which the controller 1000 communicates, such as a server or computer.

Further, the claims may be provided as a utility application, background daemon, or component of an operating system, or combination thereof, executing in conjunction with the CPU 1001 and an operating system such as Microsoft Windows 7, Microsoft Windows 10, UNIX, Solaris, LINUX, Apple MAC-OS and other systems known to those skilled in the art.

The hardware elements in order to achieve the controller 1000 may be realized by various circuitry elements, known to those skilled in the art. For example, the CPU 1001 may be a Xenon or Core processor from Intel of America or an Opteron processor from AMD of America, or may be other processor types that would be recognized by one of ordinary skill in the art. Alternatively, the CPU 1001 may be implemented on an FPGA, ASIC, PLD or using discrete logic circuits, as one of ordinary skill in the art would recognize. Further, the CPU 1001 may be implemented as multiple processors cooperatively working in parallel to perform the instructions of the inventive processes described above.

The controller 1000 in FIG. 10 also includes a network controller 1006, such as an Intel Ethernet PRO network interface card from Intel Corporation of America, for interfacing with network 1060. As can be appreciated, the network 1060 can be a public network, such as the Internet, or a private network such as an LAN or WAN network, or any combination thereof and can also include PSTN or ISDN sub-networks. The network 1060 can also be wired, such as an Ethernet network, or can be wireless such as a cellular network including EDGE, 3G and 4G wireless cellular systems. The wireless network can also be WiFi, Bluetooth, or any other wireless form of communication that is known.

The controller 1000 further includes a display controller 1008, such as a NVIDIA GeForce GTX or Quadro graphics adaptor from NVIDIA Corporation of America for interfacing with display 1010, such as a Hewlett Packard HPL2445w LCD monitor. A general purpose I/O interface 1012 may also be provided.

A sound controller 1020 is also provided in the controller 1000 such as Sound Blaster X-Fi Titanium from Creative, to interface with speakers/microphone 1022 thereby providing sounds and/or music.

The general purpose storage controller 1024 connects the storage medium disk 1004 with communication bus 1026, which may be an ISA, EISA, VESA, PCI, or similar, for interconnecting all of the components of the controller 1000. A description of the general features and functionality of the display 1010, as well as the display controller 1008, storage controller 1024, network controller 1006, sound controller 1020, and general purpose I/O interface 1012 is omitted herein for brevity as these features are known.

The exemplary circuit elements described in the context of the present disclosure may be replaced with other elements and structured differently than the examples provided herein. Moreover, circuitry configured to perform features described herein may be implemented in multiple circuit units (e.g., chips), or the features may be combined in circuitry on a single chipset.

Moreover, the present disclosure is not limited to the specific circuit elements described herein, nor is the present disclosure limited to the specific sizing and classification of these elements. For example, the skilled artisan will appreciate that the circuitry described herein may be adapted standard on changes on battery sizing and chemistry, or standard on the requirements of the intended back-up load to be powered.

The functions and features described herein may also be executed by various distributed components of a system. For example, one or more processors may execute these system functions, wherein the processors are distributed across multiple components communicating in a network. The distributed components may include one or more client and server machines, which may share processing, in addition to various human interface and communication devices (e.g., display monitors, smart phones, tablets, personal digital assistants (PDAs)). The network may be a private network, such as a LAN or WAN, or may be a public network, such as the Internet. Input to the system may be received via direct user input and received remotely either in real-time or as a batch process. Additionally, some implementations may be performed on modules or hardware not identical to those described. Accordingly, other implementations are within the scope that may be claimed.

The above-described hardware description is a non-limiting example of corresponding structure for performing the functionality described herein.

Obviously, numerous modifications and variations of the present disclosure are possible in light of the above teachings. It is therefore to be understood that within the scope of the appended claims, the invention may be practiced otherwise than as specifically described herein.

The invention claimed is:

1. A solar augmented chilled-water cooling system comprising:

a vapor absorption system;

a vapor compression system;

a cooling tower; and an air handling unit (AHU);

wherein the vapor absorption system comprises:

a first evaporator;

a first condenser;

a generator;

an absorber;

a parabolic trough collector (PTC) system comprising a plurality of parabolic troughs;

a first pump and a second pump; and a first throttling valve;

wherein the vapor absorption system is in fluid communication with the vapor compression system via a fourth pump; and the vapor compression system comprises:

a compressor;

a second condenser;

a third pump;

a second evaporator; and a second throttling valve;

wherein a hot outlet stream from the second condenser is connected to an inlet of the cooling tower, and a cool water stream from the cooling tower is connected to a first three-way valve; and and the cooling tower comprises:

a plurality of chillers;

a plurality of tubes to transfer a coolant fluid to the plurality of chillers; and a first heat exchanger;

wherein the cooling tower is in fluid communication with the vapor absorption system through the first three-way valve; and the cooling tower has a plurality of slits configured so that cool air enters the cooling tower through the slits and exits through the top of the tower; and the cooling tower is configured to supply water to the first evaporator to further reduce the temperature of water from the cooling tower via the first three-way valve;

the cool water stream from the cooling water tower is in fluid communication with an inlet stream of the first evaporator;

an outlet stream of the first evaporator is in fluid communication with a second three-way valve, wherein an outlet stream from the second three-way valve is connected to the fourth pump; and a temperature difference between the inlet stream of the first evaporator and an outlet stream of the first evaporator is between 20° C. and 60° C.;

the cooling tower is configured to directly supply water to the second condenser via the first three-way valves;

the cooling tower allows a portion of the water to pass through the first evaporator before mixing with remaining water coining directly from the cooling tower and passing to the second condenser;

the PTC system provides thermal energy to the generator where a liquid with low boiling point is evaporated to form a vapor.

2. The system of claim 1, wherein the water from the cooling tower passes through the second evaporator before traveling to the second condenser.

3. The system of claim 1, wherein a power conditioning unit further comprises an AC connect and a DC connect to supply power to the vapor compression system.

4. The system of claim 1, wherein the cooling tower is fluidly connected to second condenser by passing a water stream exiting the second condenser to the cooling tower.

5. The system of claim 1, wherein the first evaporator is fluidly connected to the second condenser by passing a water stream exiting the first evaporator to the second condenser.

6. The system of claim 1, wherein the first evaporator is fluidly connected to the second condenser by a second three-way valve.

7. The system of claim 1, wherein the first evaporator is fluidly connected to the second condenser by passing the water stream exiting the second three-way valve through the fourth pump to the second condenser.

8. The system of claim 1, wherein the second evaporator is fluidly connected to the AHU by passing a water stream exiting the second evaporator to the AHU through the third pump.

9. The system of claim 8, wherein the AHU is fluidically connected to the second evaporator by exposing the water stream to a supplied air stream in the AHU and returning the water stream to the second evaporator.

10. The system of claim 1, wherein the second evaporator comprises a second heat exchanger.

11. The system of claim 10, wherein the second heat exchanger is fluidically connected to the AHU to exchange heat with an air stream returning from the AHU.

12. The system of claim 10, further comprising a second vapor compression system which comprises six three-way valves to exchange heat with the AHU.

13. The system of claim 10, wherein the second heat exchanger is in fluid communication with the air handling unit.

14. The system of claim 13, the cooling tower is fluidly connected to the vapor absorption system by a first three-way valve to pass the water stream through the first three-way valve.

15. The system of claim 14, wherein the PTC is fluidly connected to the generator.

* * * * *